US011060785B2

(12) United States Patent
Jeong et al.

(10) Patent No.: US 11,060,785 B2
(45) Date of Patent: Jul. 13, 2021

(54) REFRIGERATOR

(71) Applicant: Samsung Electronics Co., Ltd., Suwon-si (KR)

(72) Inventors: Jin Jeong, Yongin-si (KR); Kook Jeong Seo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 173 days.

(21) Appl. No.: 14/757,624

(22) Filed: Dec. 23, 2015

(65) Prior Publication Data

US 2016/0187048 A1 Jun. 30, 2016

(30) Foreign Application Priority Data

Dec. 24, 2014 (KR) ..... 10-2014-0188024

(51) Int. Cl.
*F25D 17/06* (2006.01)
*F25D 11/00* (2006.01)

(52) U.S. Cl.
CPC ..... *F25D 17/065* (2013.01); *F25D 11/006* (2013.01); *F25D 2317/067* (2013.01)

(58) Field of Classification Search
CPC .... F25D 17/065; F25D 11/006; F25D 25/028; F25D 2400/04; F25D 2317/067; F25D 2317/065; F25D 2317/0653; F25D 2317/0667; F25D 2317/0671; F25D 2317/0672; F25D 2321/142; F25D 2321/144; F25D 2321/1441; F25D 2303/08; F25D 2303/083; F25D 2303/084; F25D 19/006; F25D 16/00; F25D 17/067; F25D 17/08; F25D 2400/2317; F25D 2400/067; F25D 2400/065; F25D 2400/0653; F25D 2400/0667; F25D 2400/0671; F25D 2400/0672; F25D 2303/00; F25D 2303/082; F25D 2303/0831; F25D 2303/0832; F25D 17/062; F25C 2400/10
See application file for complete search history.

(56) References Cited

U.S. PATENT DOCUMENTS 2,359,780 A * 10/1944 Muffly ..... F25B 5/02 62/138
3,070,973 A * 1/1963 O'Connell ..... F25D 11/006 62/180

(Continued)

FOREIGN PATENT DOCUMENTS

CN 1124056 A 6/1996
CN 1334431 A 2/2002

(Continued)

OTHER PUBLICATIONS

Chinese Office Action for Appln. No. 201510977915.2 dated Aug. 30, 2017.

(Continued)

*Primary Examiner* — Jianying C Atkisson
*Assistant Examiner* — Miguel A Diaz
(74) *Attorney, Agent, or Firm* — Staas & Halsey LLP

(57) ABSTRACT

Disclosed herein is a refrigerator in which a cold storage material suitable for a freezing chamber may be packed in a cool pack for the freezer section and/or the refrigerator section to keep the respective sections cooler if there is a power failure.

10 Claims, 20 Drawing Sheets

(56) References Cited

U.S. PATENT DOCUMENTS 4,580,623 A * 4/1986 Smitte ..... F25B 39/02 165/150
4,918,936 A * 4/1990 Sakamoto ..... F25B 5/04 62/117
5,664,437 A * 9/1997 Park ..... F25D 17/045 62/407
5,704,224 A * 1/1998 Choi ..... F25D 17/065 62/407
5,718,123 A * 2/1998 Park ..... F25D 17/045 62/407
5,722,252 A * 3/1998 Kang ..... A47F 3/0482 62/408
5,884,496 A * 3/1999 Kim ..... F24F 13/06 62/186
5,921,104 A * 7/1999 Chang ..... F24F 9/00 62/407
5,946,934 A * 9/1999 Kim ..... F25D 17/045 62/187
7,543,455 B1 * 6/2009 Chen ..... F25B 27/005 62/235.1
7,966,842 B2 6/2011 Kamisako
8,033,134 B2 * 10/2011 Litch ..... F25D 17/065 62/408
8,250,881 B1 * 8/2012 Reihl ..... F25D 11/006 62/180
9,016,070 B2 * 4/2015 Boarman ..... F25D 11/006 62/3.1
9,140,479 B2 * 9/2015 Gomes ..... F25D 29/00
9,488,403 B2 * 11/2016 Kulkarni ..... F25D 11/022
9,523,522 B2 * 12/2016 Chou ..... F25B 39/028
9,528,730 B2 * 12/2016 Boarman ..... F25D 11/006
9,810,472 B2 * 11/2017 Gomes ..... F25D 11/02
2008/0202128 A1 * 8/2008 Flanagan ..... C09K 5/10 62/62
2009/0045680 A1 2/2009 Litch et al.
2010/0077791 A1 4/2010 Kamisako et al.
2010/0115973 A1 * 5/2010 Kondou ..... F25B 5/02 62/115
2010/0126191 A1 * 5/2010 Han ..... F25D 21/02 62/80
2010/0223944 A1 9/2010 Tsujimoto et al.
2011/0011106 A1 * 1/2011 Ahn ..... F25D 17/065 62/89
2012/0055191 A1 * 3/2012 Lee ..... F25D 11/006 62/459
2013/0019623 A1 * 1/2013 Jo ..... F25D 11/025 62/190
2013/0152621 A1 * 6/2013 Lee ..... F25D 11/025 62/441
2013/0160484 A1 * 6/2013 Lee ..... F25D 11/006 62/452
2014/0075963 A1 3/2014 Boarman
2014/0331711 A1 * 11/2014 Blezard ..... F25D 3/08 62/457.2
2015/0143831 A1 * 5/2015 Chou ..... F28F 3/14 62/129
2016/0054041 A1 * 2/2016 Choi ..... F25B 5/02 62/115
2016/0097578 A1 * 4/2016 Hyun ..... F25D 17/062 62/96
2016/0138849 A1 * 5/2016 Lee ..... F25D 17/06 62/186
2016/0153693 A1 * 6/2016 Oyu ..... F25D 17/045 62/276
2017/0115048 A1 * 4/2017 Zardo ..... F25D 11/02
2017/0122649 A1 * 5/2017 Im ..... F25B 39/00
2017/0205131 A1 * 7/2017 Yun ..... F25D 11/025
2018/0087831 A1 * 3/2018 Chou ..... F25D 31/006
2018/0252466 A1 * 9/2018 Baker ..... F25D 11/006
2019/0226748 A1 * 7/2019 Chezem ..... F25D 17/065

FOREIGN PATENT DOCUMENTS

CN 1648562 A 8/2005
CN 2814277 Y 9/2006
CN 202216466 U 5/2012
JP H0571847 3/1993
JP H05322412 12/1993
JP 07004819 A * 1/1995 ..... F25D 11/006
JP 8-511088 11/1996
JP 2005282948 10/2005
JP 2005282948 A * 10/2005
JP 2006-118825 5/2006
JP 2009000071 A 10/2009
JP 2010-91204 4/2010
JP 2012242064 A 12/2012
JP 2012242073 12/2012
KR 10-2010-0014964 2/2010
KR 10-2012-0117704 10/2012
KR 10-1458199 11/2014
WO 95/33963 12/1995
WO WO-2011018345 A1 * 2/2011 ..... F25D 11/006
WO WO-2018205516 A1 * 11/2018 ..... F25D 17/08

OTHER PUBLICATIONS

Chinese Office Action for Appln. No. 201510977915.2 dated Mar. 14, 2018.
Chinese Patent Office Action issued in Chinese Patent Application No. 201510977915.2 dated Sep. 14, 2018 (16 pages).
Chinese Patent Office Action issued in Chinese Patent Application No. 201510977915.2 dated Mar. 6, 2019 (4 pages).
Indian Office Action dated Jun. 25, 2019 in corresponding Indian Patent Application No. 4722/MUM/2015.
Korean Office Action dated Jan. 25, 2021 in Korean Patent Application No. 10-2014-0188024.

* cited by examiner

REFRIGERATOR

RELATED APPLICATION(S)

This application claims the benefit of Korean Patent Application No. 10-2014-0188024, filed on Dec. 24, 2014 in the Korean Intellectual Property Office, the disclosure of which is incorporated herein by reference.

BACKGROUND

Embodiments of the present disclosure relate to a refrigerator, and more particularly, to a refrigerator that may delay increase in the temperature of a freezing chamber and a refrigerating chamber when a power failure occurs.

Generally, a refrigerator is an apparatus that includes a storage chamber and a cold air supply device for supplying cold air to the storage chamber to keep food fresh. The inside of the storage chamber is maintained at a temperature in a predetermined range required to keep food fresh. Such a storage chamber of the refrigerator has a door to provide access to the food, where the door is kept closed normally to maintain the temperature of the storage chamber.

The storage chamber may be divided into a refrigerating chamber and a freezing chamber by a partition wall, and the freezing chamber and the refrigerating chamber may have a freezing chamber door and a refrigerating chamber door, respectively.

The internal temperature of each of the freezing chamber and the refrigerating chamber is normally maintained by the cold air supply device, but when there is a power failure, the supply of cold air to the freezing chamber and the refrigerating chamber is stopped so the temperature inside the freezing chamber and the refrigerating chamber increases. As the temperature inside the freezing chamber and the refrigerating chamber increases, food or the like stored in the freezing chamber and the refrigerating chamber may spoil.

In order to alleviate the effects of a power failure, a first cool pack and a second cool pack are respectively provided in the freezing chamber and the refrigerating chamber in order to delay the increase in the internal temperature of the freezing chamber and the refrigerating chamber when a power failure occurs. The first cool pack and the second cool pack may be kept at an appropriate temperature by the cold air when the refrigerator has power. When a power failure occurs, the first and second cold packs may delay temperature increase in the freezing chamber and the refrigerating chamber, respectively.

The cold storage material in the first cool pack for the freezing chamber goes through a phase change at a temperature of approximately 0° C. or lower to store the cold storage energy. This cold storage material will be referred to as the freezer cold storage material. The cold storage material in the second cool pack for the refrigerating chamber goes through a phase change at a temperature of approximately 6° C. to store the cold storage energy. This cold storage material will be referred to as the refrigerator cold storage material. The refrigerator cold storage material that goes through the phase change at the temperature of approximately 6° C. may cost about ten or more times than the freezer cold storage material.

In a case of a top mounted freezer (TMF) type refrigerator in which the freezing chamber is provided in the upper portion of the storage chamber and the refrigerating chamber is provided in the lower portion, the refrigerator is produced with low costs, and, therefore, the material cost increase for the second cool pack for the refrigerating chamber may become a burden.

SUMMARY

Therefore, it is an aspect of the present disclosure to provide a refrigerator in which freezer cold storage material used in the cool pack for the freezing chamber may be used in a cool pack for the refrigerating chamber. The cool pack, in general, may act as a cold thermal mass by being cooled by the surrounding air during normal operation of the refrigerator. When power is lost to the refrigerator, the cold thermal mass of the cool pack may absorb heat from the refrigerator to keep the food cold/frozen longer. For ease of explanation, the process of the cool pack being cooled will be referred to as "storing cold storage energy," and the process of the cool pack absorbing heat will be referred to as "supplying cold storage energy."

Additional aspects of the disclosure will be set forth in part in the description which follows and, in part, will be obvious from the description, or may be learned by practice of the disclosure.

In accordance with one aspect of the present disclosure, a refrigerator may comprise a main body, a storage chamber inside the main body divided into a freezing chamber and a refrigerating chamber by a partition wall, an evaporator in the freezing chamber configured to generate cold air, and a cold air duct in a rear portion of the refrigerating chamber configured to supply the cold air to the refrigerating chamber via a flow passage, where the cold air duct comprises a first cool pack configured to hold freezer cold storage material.

An evaporator cover may be in front of the evaporator, and a blowing fan above the evaporator may be configured to blow the cold air to the freezing chamber and the refrigerating chamber.

The flow passage may include a first flow passage separated from the freezing chamber by the evaporator cover, a second flow passage behind the cold air duct, a connection flow passage through the partition wall that connects the first flow passage and the second flow passage, and a suction flow passage inside the partition wall to allow the cold air to flow from the freezing chamber to the first flow passage via the suction flow passage.

Also, the evaporator cover may have a discharge port to allow the cold air in the first flow passage to flow to the freezing chamber. There may be a suction port on a bottom surface of the freezing chamber to allow the cold air in the freezing chamber to flow to the suction flow passage.

A drain unit may be provided below the cold air duct to collect dew, where the dew may form on a front surface of the cold air duct because of temperature difference between an internal temperature of the refrigerating chamber and the cold air in the second flow passage.

The drain unit may have inclined surfaces inclined downwardly towards a center of the drain unit from both ends, a water storage portion between the inclined surfaces to collect the dew, and a drain port to allow dew collected in the water storage portion to drain outside the main body.

Also, the cold air duct may comprise the first cool pack, an input port for introducing the freezer cold storage material to the first cool pack, and a plurality of first cold air discharge ports to allow the cold air in the second flow passage to flow to the refrigerating chamber.

There may be a cold air duct cover in front of the cold air duct and spaced apart from the cold air duct. Also, in the cold air duct cover, there may be a plurality of second cold air discharge ports provided in positions corresponding to the plurality of first cold air discharge ports.

The refrigerator may also comprise a damper configured to open and close in the connection flow passage, and a control unit for controlling operation of the damper. The control unit may include a capacitor or a battery for providing power to operate the damper when a power failure occurs.

Also, the control unit is configured to operate the blowing fan when power failure occurs. A second cool pack with the freezer cold storage material is provided inside the freezing chamber.

In accordance with another aspect of the present disclosure, a refrigerator may include a main body, a storage chamber inside the main body divided into a freezing chamber and a refrigerating chamber by a partition wall, an evaporator in the freezing chamber configured to generate cold air, a flow passage to allow the cold air to flow to the freezing chamber and the refrigerating chamber, and a first cool pack in the freezing chamber and a second cool pack in the storage chamber, where both cool packs have the freezer cold storage material. The first cool pack may be to delay rise of the temperature of the freezing chamber, and the second cool pack may be to delay rise of the temperature of the refrigerating chamber.

An evaporator cover may be in front of the evaporator, and a blowing fan above the evaporator may be configured to blow the cold air to the freezing chamber and the refrigerating chamber. Also, the flow passage may comprise a first flow passage separated from the freezing chamber by the evaporator cover, a second flow passage behind the cold air duct in a rear portion of the refrigerating chamber, a connection flow passage through the partition wall that connects the first flow passage and the second flow passage, and a suction flow passage inside the partition wall to allow the cold air to flow from the freezing chamber to the first flow passage via the suction flow passage.

A discharge port may allow the cold air in the first flow passage to flow to the freezing chamber, and a suction port on a bottom surface of the freezing chamber may allow the cold air in the freezing chamber to flow to the suction flow passage.

The second cool pack may be inside the partition wall, and positioned below the suction flow passage, where cold storage energy stored in the second cool pack may be from the cold air passing through the suction flow passage. Also, a plurality of embossed shapes are provided on a bottom surface of the second cool pack. A cool pack cover may also be provided below the second cool pack, and a plurality of holes may be provided in the cool pack cover. The cold storage energy stored in the second cool pack may be provided to the refrigerating chamber by flow of the cold air through the plurality of holes of the cool pack cover.

Also, a refrigerant pipe, in which refrigerant is circulated, is provided in an upper portion outside an inner box forming the refrigerating chamber and a rear wall outside the inner box, and the cold storage energy stored in the second cool pack may be provided to the refrigerating chamber via the refrigerant.

The second cool pack is provided on the bottom surface of the freezing chamber and positioned above the suction flow passage.

The cold storage energy stored in the second cool pack may be from the cold air flowing in the second flow passage via the suction flow passage and the connection flow passage, and the cold air in the second flow passage may flow in to the refrigerating chamber.

The second cool pack may be provided in the evaporator cover and cold storage energy stored in the second cool pack may be from the cold air passing through the first flow passage.

Also, the cold storage energy stored in the second cool pack may be provided to the refrigerating chamber by flow of cold air via the first flow passage connection, the flow passage, the second flow passage, and through the cold air duct.

Also, a cool pack may be provided in the evaporator cover and another cool pack is provided in the cold air duct, so that cold storage energy stored in the cool packs may be from the cold air flowing through the first flow passage and the second flow passage, respectively. The cold storage energy stored in the cool packs may be provided to the refrigerating chamber.

In accordance with still another aspect of the present disclosure, a refrigerator includes a main body, a storage chamber inside the main body such that its front surface is open, and divided into an upper freezing chamber and a lower refrigerating chamber by a partition wall, an evaporator in the freezing chamber configured to generate cold air; a suction flow passage that is provided inside the partition wall, and allows the cold air in the freezing chamber, circulated in the freezing chamber to flow out of the freezing chamber, a cool pack, in which cold storage material for the freezing chamber is packed, below the suction flow passage, and configured to store cold storage energy from the cold air flowing in the suction flow passage, and a refrigerant pipe provided in an upper portion outside an inner box forming the refrigerating chamber and a rear wall outside the inner box, so that refrigerant is circulated in the refrigerant pipe. When there is power failure, the refrigerant passing through the refrigerant pipe in the upper portion outside the inner box may condense due the cold storage energy stored in the cool pack, and the condensed refrigerant flows to the refrigerant pipe provided in the rear wall outside the inner box, where the refrigerant may cool the refrigerating chamber through evaporation.

A drain unit may be provided below the refrigerant pipe inside the refrigerating chamber. Also, the drain unit may comprise inclined surfaces provided to be inclined downwardly towards a center of the drain unit from both ends thereof, a water storage portion provided between the inclined surfaces, and a drain port.

There may be a blowing fan above the evaporator, where the blowing fan is controlled to be on for a first predetermined time when a compressor is off for a second predetermined time. Also, a time during which the cold air is supplied to the freezing chamber is increased by increasing a time when the compressor is on to compensate for an acceleration of the increase in the temperature of the freezing chamber because the increase in the temperature of the freezing chamber is accelerated by the refrigerant circulated in the refrigerant pipe when the compressor is off.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
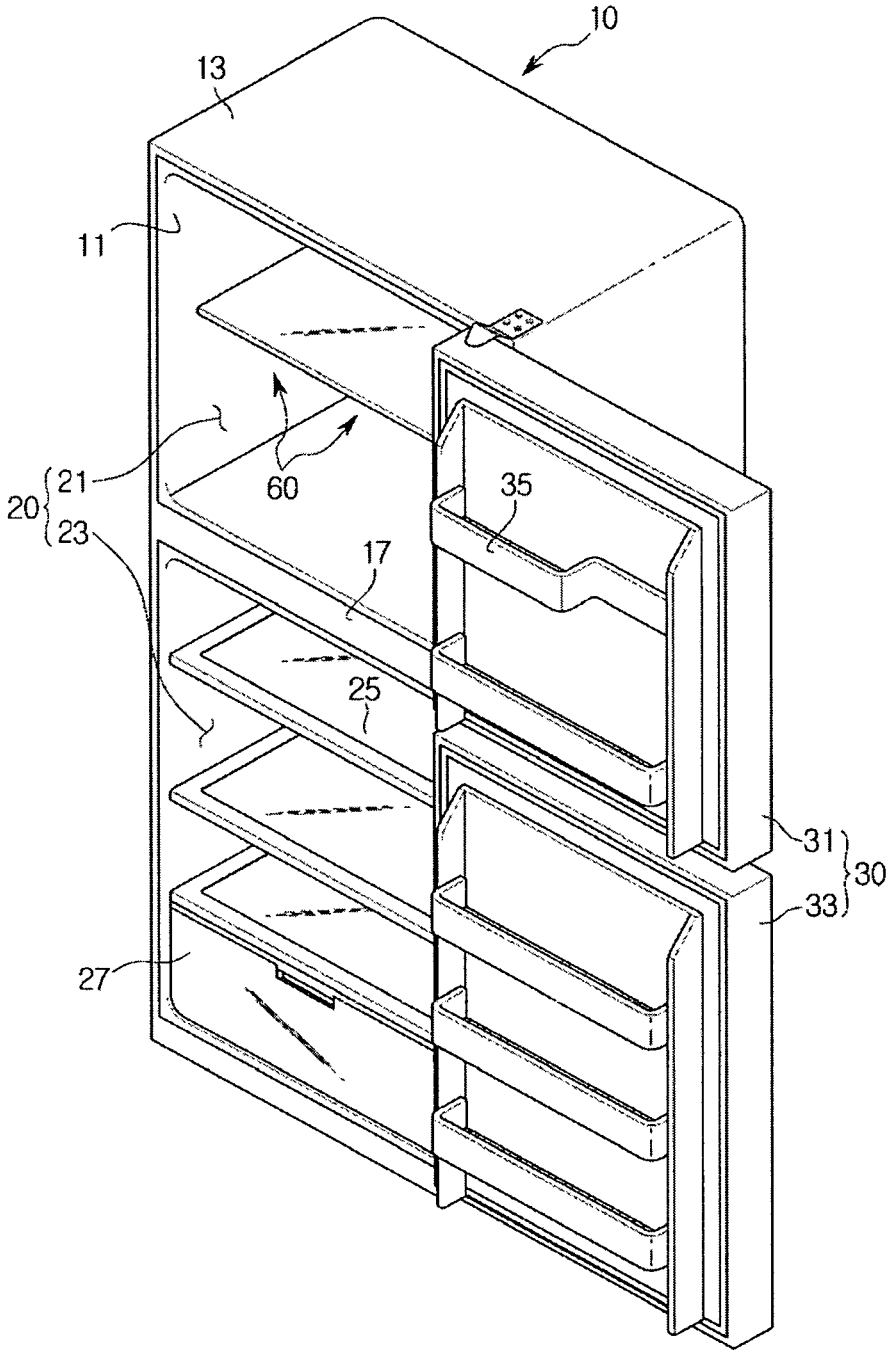
FIG. 1 is a perspective view of a refrigerator in accordance with one embodiment of the present disclosure.
Figure 2:
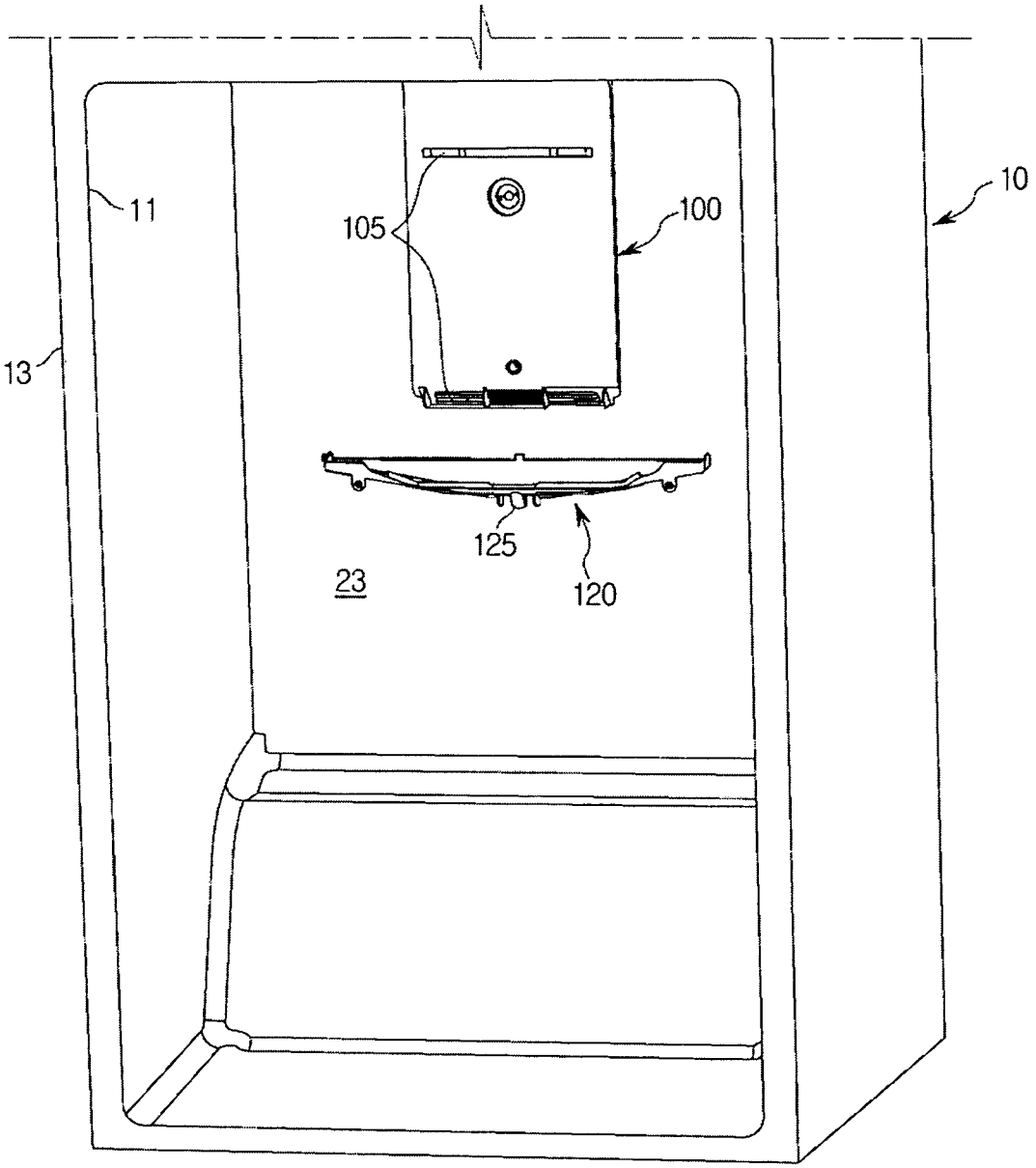
FIG. 2 is a view showing a cold air duct and a drain unit in accordance with one embodiment of the present disclosure.
Figure 3:
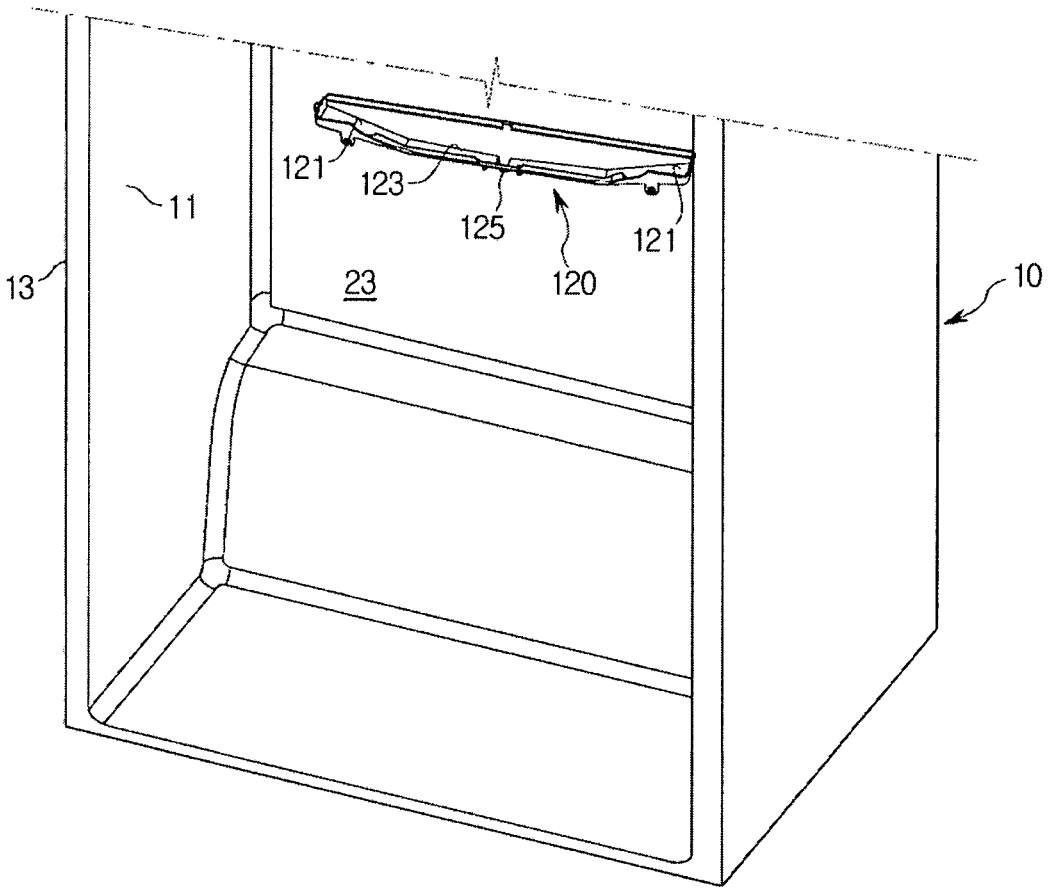
FIG. 3 is a view showing the drain unit of FIG. 2 from a different angle.
Figure 4:
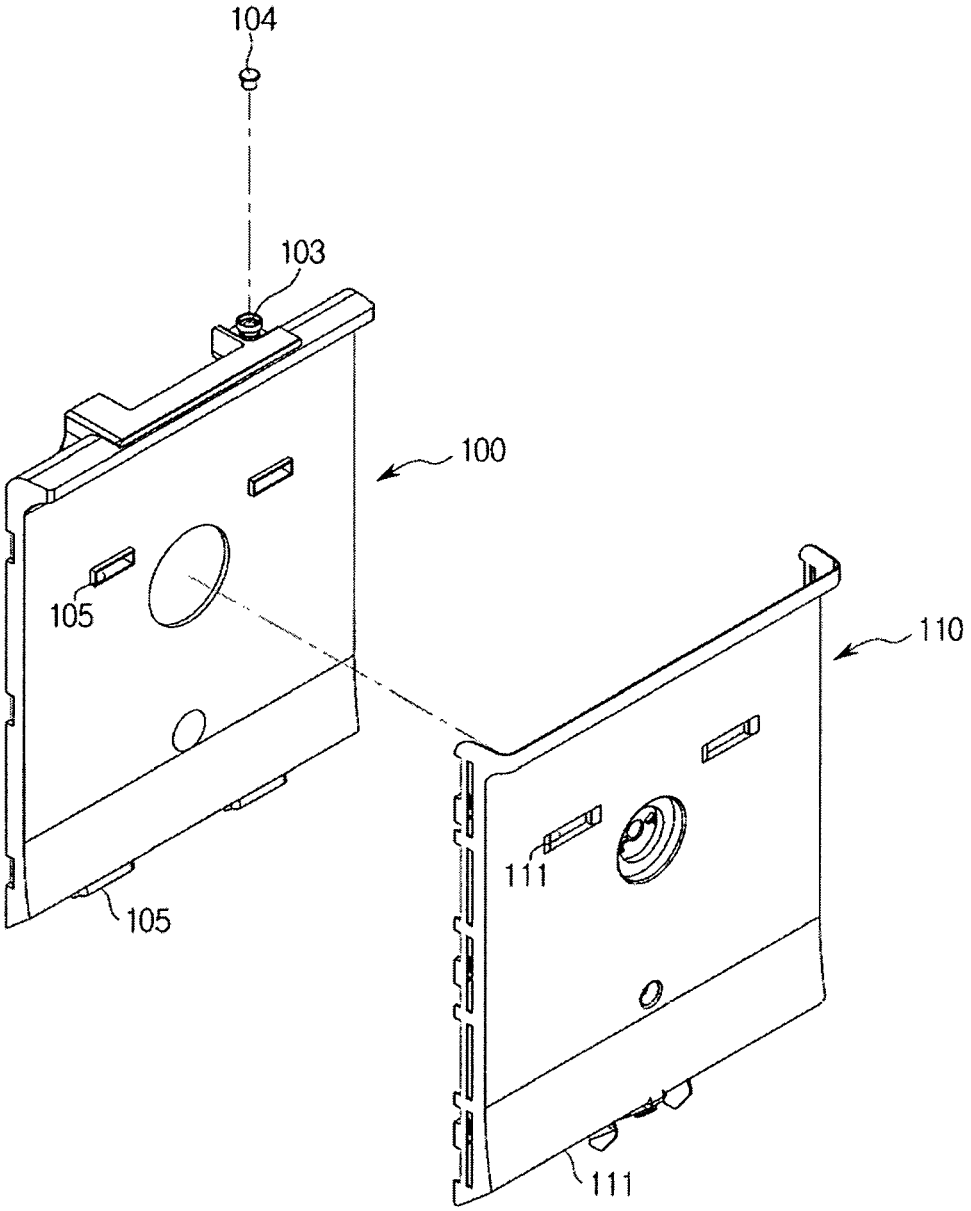
FIG. 4 is a view showing a cold air duct and a cold air duct cover in accordance with one embodiment of the present disclosure.
Figure 5:
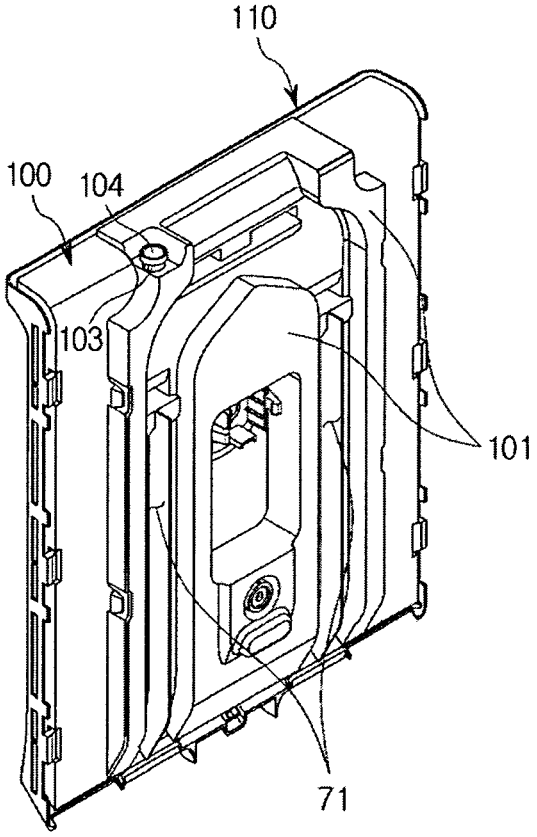
FIG. 5 is a view showing a rear surface of the cold air duct in accordance with one embodiment of the present disclosure.

Reference will now be made in detail to the embodiments of the present disclosure, examples of which are illustrated in the accompanying drawings, where like reference numerals refer to like elements throughout.

As shown in FIGS. 1 to 6, a refrigerator includes a main body 10, a storage chamber 20 that is provided inside the main body 10 in such a manner that its front surface is open, and doors 30 that are rotatably coupled to the main body 10 to cover the open front surface of the storage chamber 20.

The main body 10 includes an inner box 11 that forms the storage chamber 20 and an outer box 13 that forms the appearance, and a heat insulating material 15 is foamed and packed between the inner box 11 and the outer box 13 to prevent the leakage of cold air.

The storage chamber 20 is divided into a freezing chamber 21, which may be an upper storage chamber, and a refrigerating chamber 23, which may be a lower storage chamber, by a partition wall 17. The freezing chamber 21 and the refrigerating chamber 23 may have shelves 25 on which food or the like can be placed. In addition, a storage container 27 in which food or the like is stored may be provided inside the storage chamber 20.

A machine section 29 in which a compressor 41 for compressing a refrigerant and a condenser (not shown) for condensing the compressed refrigerant are installed is provided on a lower-rear side of the main body 10.

The freezing chamber 21 and the refrigerating chamber 23 are opened and closed respectively by a freezing chamber door 31 and a refrigerating chamber door 33 that are rotatably coupled to the main body 10, and a plurality of door trays 35 capable of receiving food or the like may be provided on the inner surface of the doors 30.

A cold air supply device 40 for supplying cold air into the storage chamber 20 is provided inside the main body 10. The cold air supply device 40 may include the compressor 41, the condenser (not shown), an expansion valve (not shown), an evaporator 43, a blowing fan 45, and the like. The compressor 41 and the condenser (not shown) are provided inside the machine section 29 as described above, and the evaporator 43 and the blowing fan 45 may be provided on a rear side of the freezing chamber 21.

While the evaporator 43 cools existing air around it, for ease of explanation, the evaporator 43 may be said to generate cold air through heat exchange of the refrigerant. The cold air generated by the evaporator 43 is then forced by the blowing fan 45, in an upper portion of the evaporator 43, to the freezing chamber 21 and the refrigerating chamber 23. An evaporator cover 50 is provided in front of the evaporator 43 on the rear side of the freezing chamber 21. The evaporator cover 50 may be spaced apart from the evaporator 43 so that the evaporator 43 may be separated from the rest of the freezing chamber 21. The evaporator cover 50 may have a plurality of discharge ports 51 for discharging the cold air generated by the evaporator 43 into the freezing chamber 21.

The cold air generated by the evaporator 43 is blown by the blowing fan 45, and part of the cold air is supplied to the freezing chamber 21 through the discharge ports 51 of the evaporator cover 50, and the remaining part of the cold air is supplied to the refrigerating chamber 23 through the cold air duct 100 provided on the rear side of the refrigerating chamber 23.

The cold air from the blowing fan 45 may go through a first flow passage 71 that is separated from the freezing chamber 21 by the evaporator cover 50, a second flow passage 73 behind the cold air duct 100, a connection flow passage 75 that connects the first flow passage 71 and the second flow passage 73 by passing through the partition wall 17, and through a suction flow passage 77. The suction flow passage 77 is provided inside the partition wall 17 to allow the cold air discharged from the first flow passage 71 through the discharge ports 51 of the evaporator cover 50 to be circulated inside the freezing chamber 21 and then to the first flow passage 71 again.

Thus, a part of the cold air generated by the evaporator 43 is discharged to the discharge ports 51 of the evaporator cover 50 via the first flow passage 71 and supplied to the freezing chamber 21, and the remaining part of the cold air is transmitted from the first flow passage 71 to the second flow passage 73 via the connection flow passage 75 and supplied into the refrigerating chamber 23 through a first cold air discharge port 105 of the cold air duct 100.

The temperatures of the freezing chamber 21 and the refrigerating chamber 23 may be maintained by the cold air generated by the evaporator 43. The cold air discharged into the freezing chamber 21 through the discharge ports 51 of the evaporator cover 50 is circulated inside the freezing chamber, and then suctioned to the suction flow passage 77 to be transmitted to the first flow passage 71 again, and the cold air transmitted to the first flow passage 71 is discharged into the freezing chamber 21 through the discharge ports 51 again.

A suction port 21*a* through which the cold air is suctioned is provided on a front side of a bottom surface of the freezing chamber 21 so that the cold air circulated inside the freezing chamber 21 may be suctioned to the suction flow passage 77. One side of the suction flow passage 77 is connected to the suction port 21*a*, and the other side thereof is connected to the connection flow passage 75, so that the cold air flowing through the suction port 21*a* may be guided to the first flow passage 71 via the suction flow passage 77 and the connection flow passage 75.

Each of the freezing chamber 21 and the refrigerating chamber 23 may maintain its temperature by receiving the cold air generated by the evaporator 43, but when a power failure occurs, the cold air cannot be supplied to the freezing chamber 21 and the refrigerating chamber 23, and therefore each of the freezing chamber 21 and the refrigerating chamber 23 cannot maintain its temperature. It should be noted that power failure may refer to any event when power is not supplied to a refrigerator.

Inside the freezing chamber 21, a cool pack 60 containing freezer cold storage material 61 is provided to delay an increase in the internal temperature of the freezing chamber 21 when a power failure occurs. The cool pack 60 may be configured to be like a shelf so that food or the like can be stored on the cool pack 60. The freezer cold storage material 61 for the freezing chamber 21 has a phase change at a temperature of approximately 0° C. or lower to store cold storage energy.

The cool pack 60 that normally stores the cold storage energy may supply the cold storage energy to the freezing chamber 21 when a power failure occurs, and thereby delay internal temperature increase of the freezing chamber 21. Inside the refrigerating chamber 23, a cool pack, which may have the refrigerator cold storage material, should be provided for the refrigerating chamber to delay internal temperature increase of the refrigerating chamber 23 when a power failure occurs, and the refrigerator cold storage material for the refrigerating chamber may cause a phase change at a temperature of approximately 6° C. or lower to store cold storage energy.

However, the cold storage material for the refrigerating chamber has a price ten or more times that of the cold storage material for the freezing chamber. Therefore, excessive costs may be spent to use a cool pack that uses the refrigerator cold storage material for the refrigerating chamber to delay the increase in the internal temperature of the refrigerating chamber 23 when a power failure occurs.

When the cool pack 60 with the freezer cold storage material 61 for the freezing chamber is disposed inside the refrigerating chamber 23 to reduce costs, the internal temperature of the refrigerating chamber 23 may be maintained at a temperature of 0° C. or higher, and, therefore, the freezer cold storage material 61 for the freezing chamber may not have a phase change to store the cold storage energy.

In various embodiments of the present disclosure, the freezer cold storage material 61 for the freezing chamber may be packed inside the cold air duct 100 provided on the rear side of the refrigerating chamber 23 to delay the increase in the internal temperature of the refrigerating chamber 23 when a power failure occurs, while reducing costs versus using the refrigerator cold storage material.

As shown in FIGS. 2 to 6, the cold air duct 100 is disposed on the rear side of the refrigerating chamber 23, and receives the cold air generated by the evaporator 43 and discharges the received cold air into the refrigerating chamber 23.

The cold air duct 100 includes a cold storage material packing portion 101 in which the freezer cold storage material 61 for the freezing chamber is packed, an input port 103 for introducing the freezer cold storage material 61 for the freezing chamber to the cold storage material packing portion 101, a plug 104 for opening and closing the input port 103, and a plurality of first cold air discharge ports 105 for supplying the cold air transmitted to the second flow passage 73 to the refrigerating chamber 23.

The cold air duct 100 with the freezer cold storage material 61 is positioned inside the refrigerating chamber 23 that maintains its temperature at a temperature of 0° C. or higher. However, the cold air generated by the evaporator 43 and transmitted to the second flow passage 73 provided in the rear surface of the cold air duct 100 maintains the temperature of 0° C. or lower, and, therefore, the freezer cold storage material 61 inside the cold air duct 100 may phase change to store the cold storage energy.

Since the cold air duct 100 is provided in the refrigerating chamber 23, the cold storage energy stored in the cold air duct 100 may be supplied to the refrigerating chamber 23 when a power failure occurs, and thereby delay the increase in the internal temperature of the refrigerating chamber 23.

The temperature of the refrigerating chamber 23 positioned in a front surface of the cold air duct 100 and the temperature of the second flow passage 73 positioned in the rear surface thereof are different from each other, and, therefore, dew formation may occur on the front surface of the cold air duct 100. A cold air duct cover 110 spaced apart from the cold air duct 100 may be formed in front of the cold air duct 100, thereby preventing dew formed on the front surface of the cold air duct 100 from being exposed to the outside when a user opens the refrigerating chamber door 33.

A plurality of second cold air discharge ports 111 may be provided in positions corresponding to the plurality of first cold air discharge ports 105 provided in the cold air duct 100 so that the cold air from the first cold air discharge ports 105 may be supplied into the refrigerating chamber 23 through the second cold air discharge ports 111.

A drain unit 120 through which the dew formed on the front surface of the cold air duct 100 flows down to be drained is provided in a lower portion of the cold air duct 100. The drain unit 120 includes inclined surfaces 121 provided to incline downward towards the center of the drain unit 120 from both ends thereof, a water storage portion 123 that is provided flatly between the inclined surfaces 121 of both ends of the drain unit 120 so that the dew flowing down from the cold air duct 100 is stored in the water storage portion 123, and a drain port 125 that is provided in a center portion of the water storage portion 123 so that the dew stored in the water storage portion 123 is drained outside of the main body 10.

The dew that drops from the left and right edge portions of the cold air duct 100 is dropped to the inclined surfaces 121 of the drain unit 120 to be moved to the water storage portion 123 along the inclined surfaces 121, and the dew stored in the water storage portion 123 is drained to the outside through the drain port 125.

Figure 7:
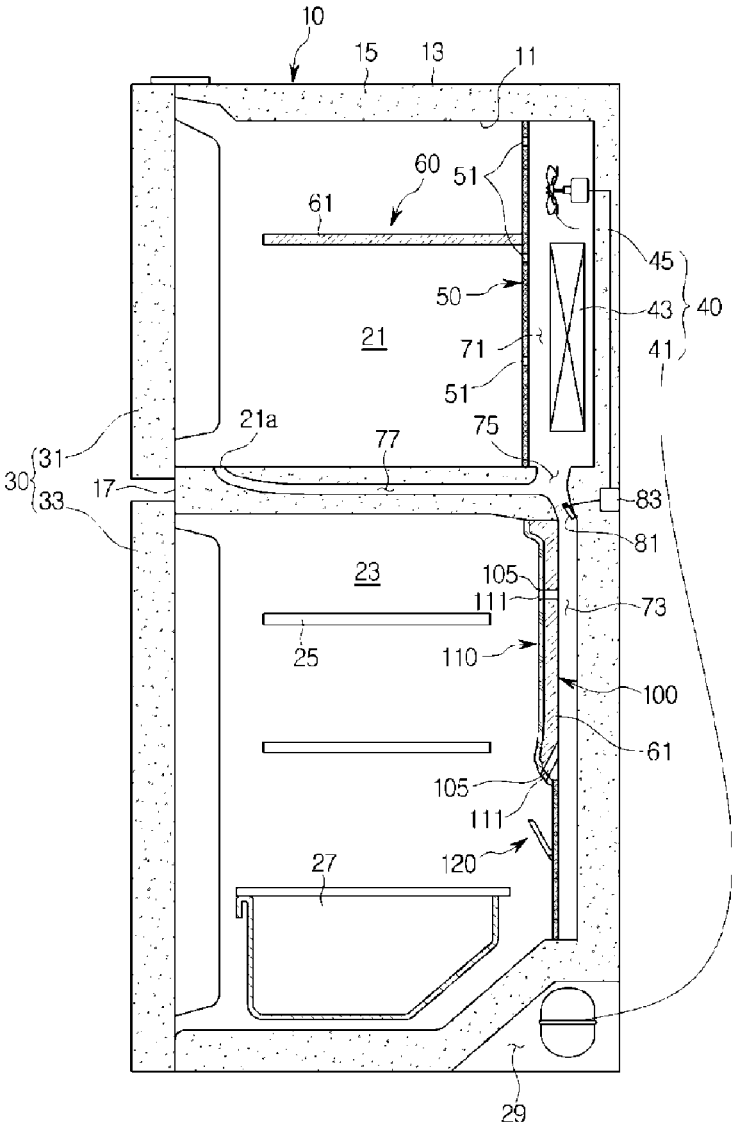
FIG. 7 is a view showing a state in which a damper and a control unit are provided in FIG. 6.
Figure 7:
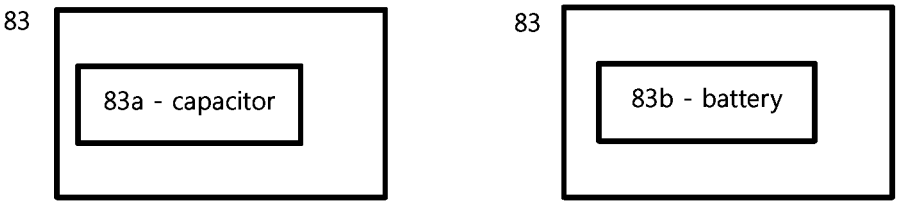

As shown in FIG. 7, a damper 81 for opening and closing the connection flow passage 75 may be provided in the connection flow passage 75, and a control unit 83 for controlling the operation of the damper 81 may be provided in the main body 10. The control unit 83 may include a capacitor 83*a* or a battery 83*b* for operating the damper 81 when a power failure occurs, and may be connected to the blowing fan 45 to control the operation of the blowing fan 45.

When power failure occurs, the control unit 83 may operate the damper 81 that opens and closes the connection flow passage 75 to open the damper 81, and the cold air generated by the evaporator 43 may flow from the first flow passage 71 to the second flow passage 73 via the connection flow passage 75. In addition, the flow of the cold air may be helped by operating the blowing fan 45 while opening the damper 81.

Figure 8:
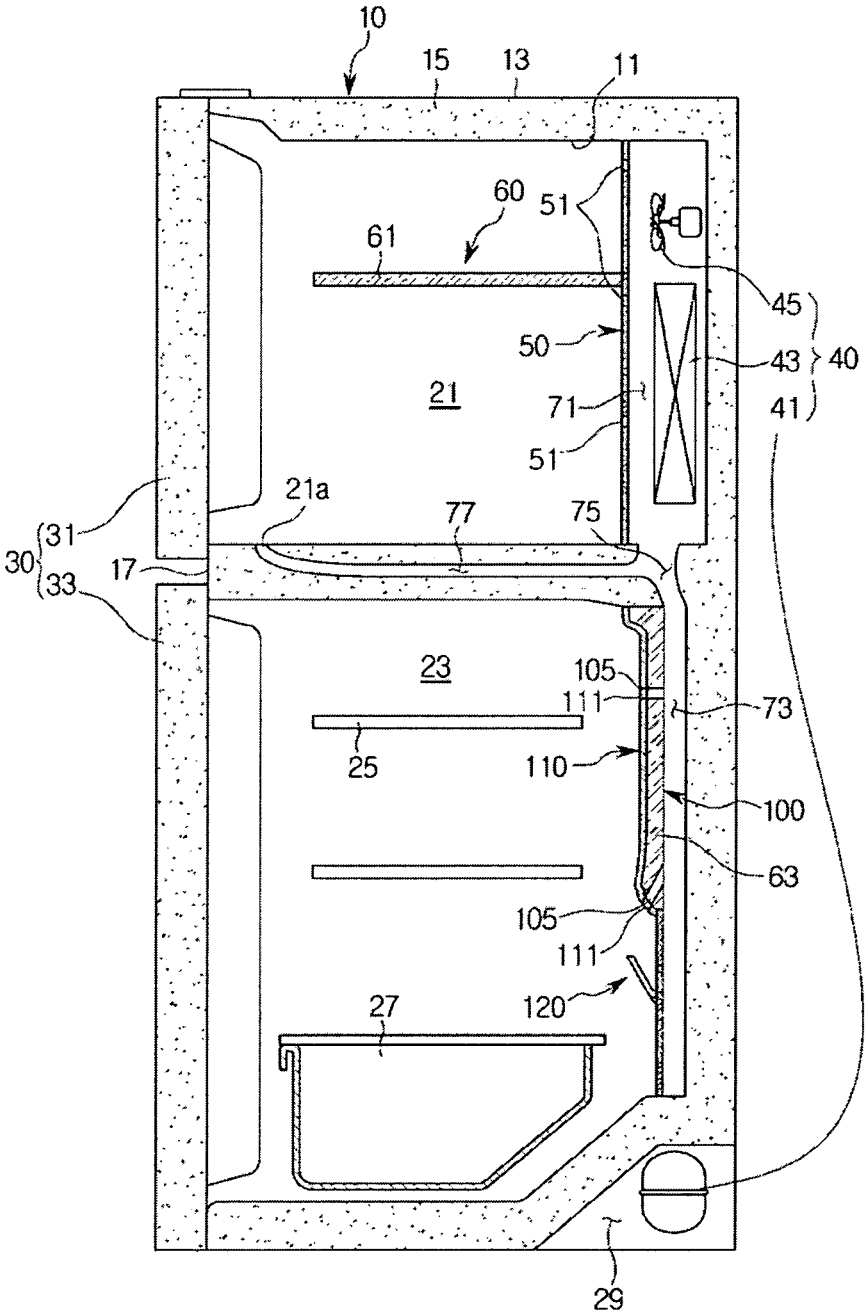
FIG. 8 is a view showing another embodiment of FIG. 6.

The freezer cold storage material 61 for the freezing chamber is packed in the cold air duct 100 to be used in order to reduce costs, but refrigerator cold storage material 63 for the refrigerating chamber may be packed in the cold air duct 100 to be used, as shown in FIG. 8.

Figure 9:
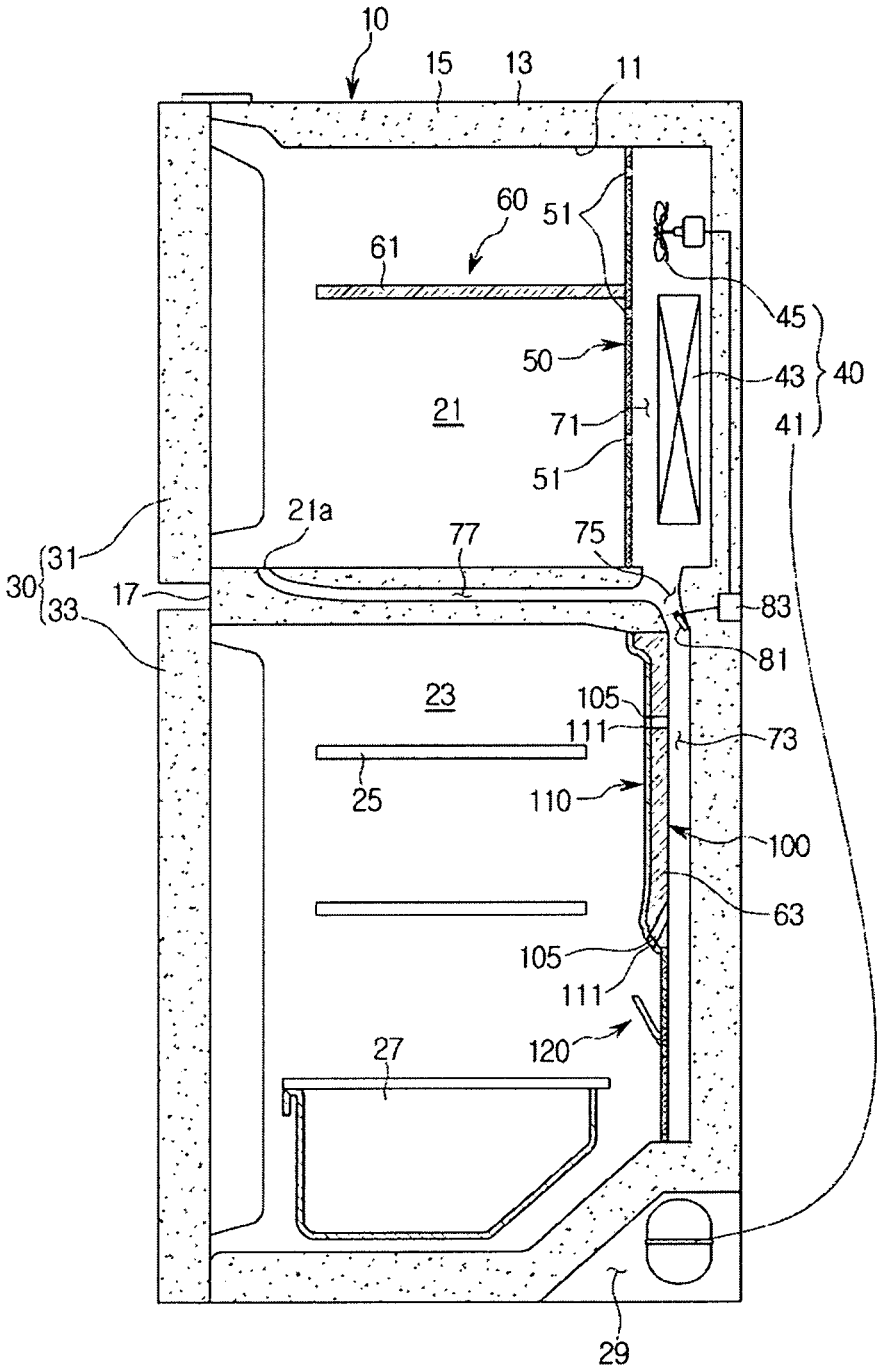
FIG. 9 is a view showing a state in which the damper and the control unit are provided in FIG. 8.

In addition, as shown in FIG. 9, even when the refrigerator cold storage material 63 for the refrigerating chamber is packed in the cold air duct 100 to be used, the configuration of the damper 81 and the control unit 83 may be used.

Next, various embodiments will be described, with reference to FIGS. 10 to 18, of using a cool pack with freezer cold storage material to delay an increase in the temperature of the refrigerating chamber when a power failure occurs.

Figure 6:
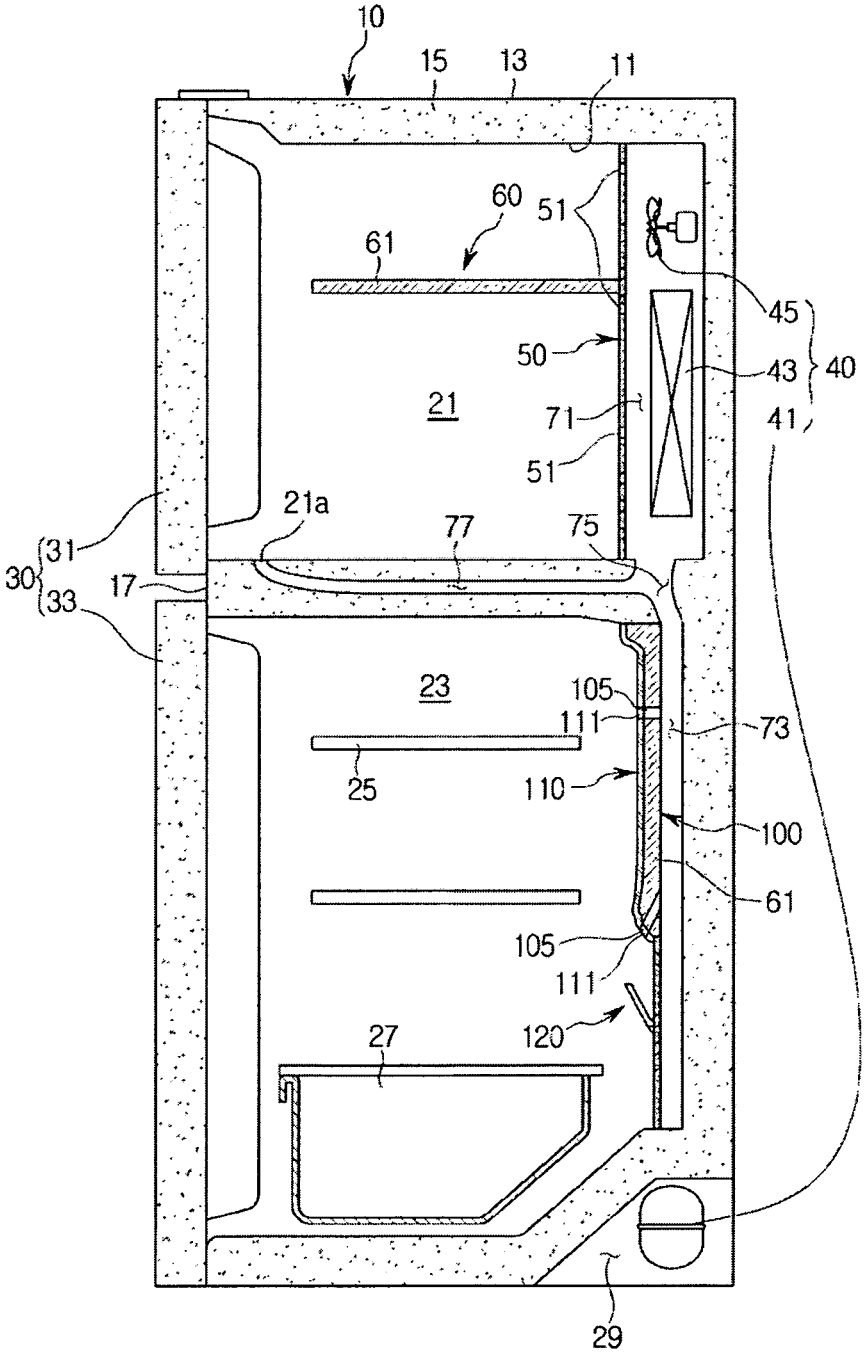
FIG. 6 is a side cross-sectional view of the refrigerator in accordance with one embodiment of the present disclosure.
Figure 10:
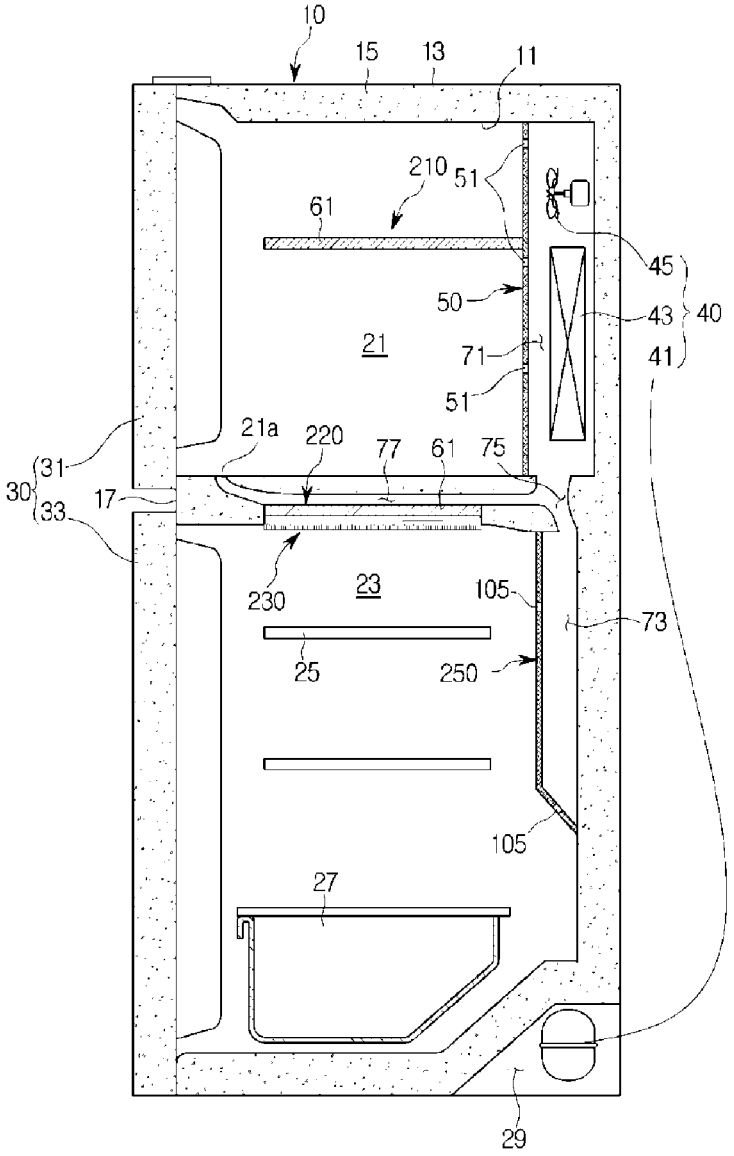
FIG. 10 is a view showing a state in which a second cool pack is provided inside a partition wall so that it is positioned below a suction flow passage in accordance with another embodiment of the present disclosure.
Figure 10:
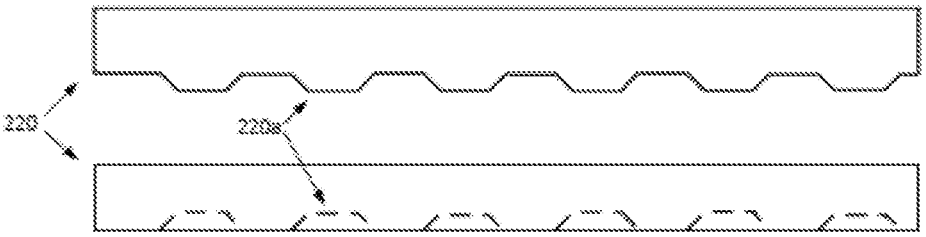
Figure 11:
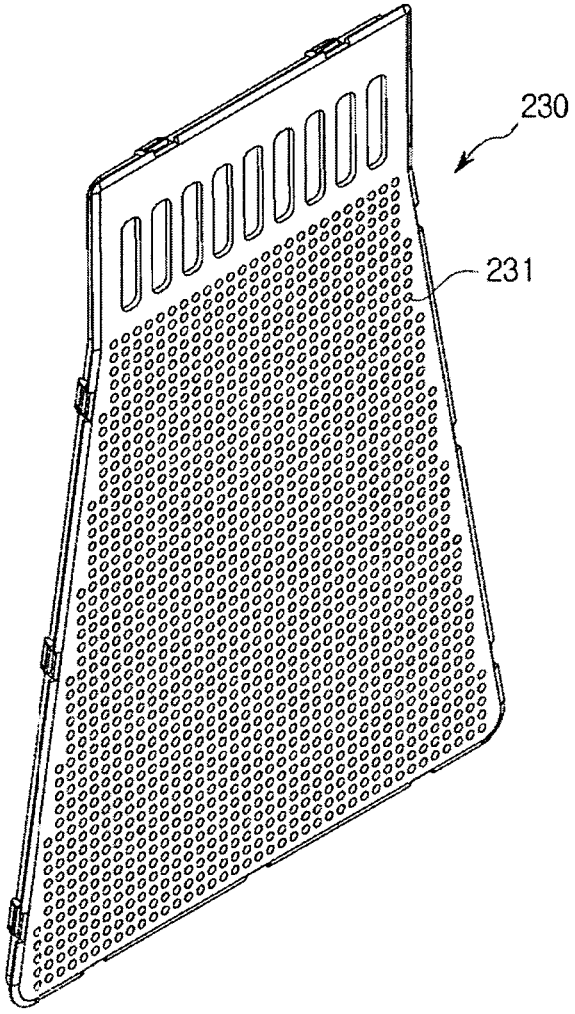
FIG. 11 is a view showing a cool pack cover shown in FIG. 10.

As shown in FIGS. 10 to 11, a configuration in which the cool pack 60 is provided in the freezing chamber 21 to thereby delay an increase in the temperature of the freezing chamber 21 when a power failure occurs may be the same as that shown in FIG. 6. For convenience of description, the cool pack 60 shown in FIG. 6 may be referred to as a first cool pack 210 in FIG. 10.

FIG. 10 shows the first cool pack 210 and the second cool pack 220. The first cool pack 210 has the freezer cold storage material 61 in order to delay an increase in the temperature of the freezing chamber 21 when a power failure occurs, and the second cool pack 220 also has the freezer cold storage material 61 for the freezing chamber to delay an increase in the temperature of the refrigerating chamber 23 when a power failure occurs. The first cool pack 210 has the same configuration as that shown in FIG. 6, so repeated description thereof will be omitted.

The second cool pack 220 with the freezer cold storage material 61 to delay the increase in the temperature of the refrigerating chamber 23 when a power failure occurs may be provided inside the partition wall 17 below the suction flow passage 77. The second cool pack 220 provided below the suction flow passage 77 may store cold storage energy from the cold air which has been generated by the evaporator 43, circulated inside the freezing chamber 21, and then passed through the suction flow passage 77 so as to be suctioned to the first flow passage 71 again.

The cold storage energy stored in the second cool pack 220 flows down to delay the increase in the internal temperature of the refrigerating chamber 23 when a power failure occurs, and for this, a space is formed below the second cool pack 220 so that the second cool pack 220 may be adjacent to the refrigerating chamber 23.

Dew is formed on a bottom surface of the second cool pack 220 due to temperature difference between the freezing chamber 21 and the refrigerating chamber 23. As shown in FIG. 10, a plurality of embossed shapes 220*a* may be provided on the bottom surface of the second cool pack 220 in order to minimize dripping of the dew formed on the bottom surface of the second cool pack 220.

In addition, in the space that allows the second cool pack 220 to be adjacent to the refrigerating chamber 23, a cool pack cover 230 with a plurality of small holes 231 may be provided. Accordingly, the dew dropping from the second cool pack 220 may for the most part be prevented from passing through the cool pack cover 230 but the cold storage energy may be transmitted by air from the second cool pack 220 to the inside of the refrigerating chamber 23 when a power failures occurs.

Figure 12:
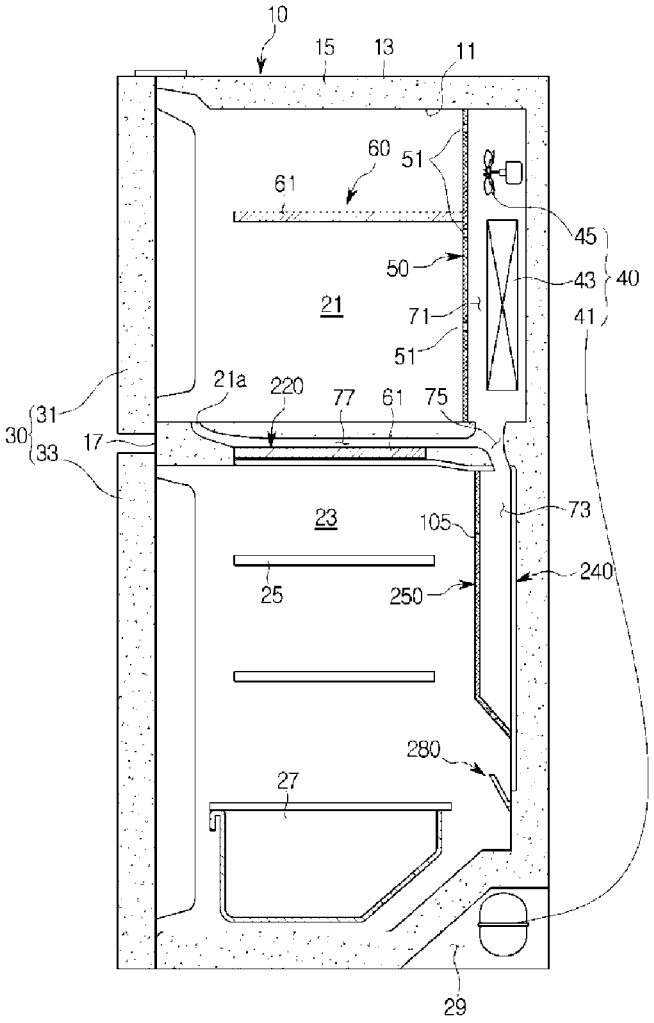
FIG. 12 is a view showing another embodiment of FIG. 10.
Figure 12:
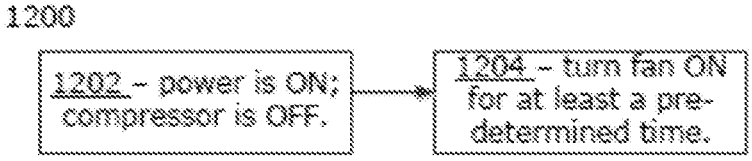
Figure 13:
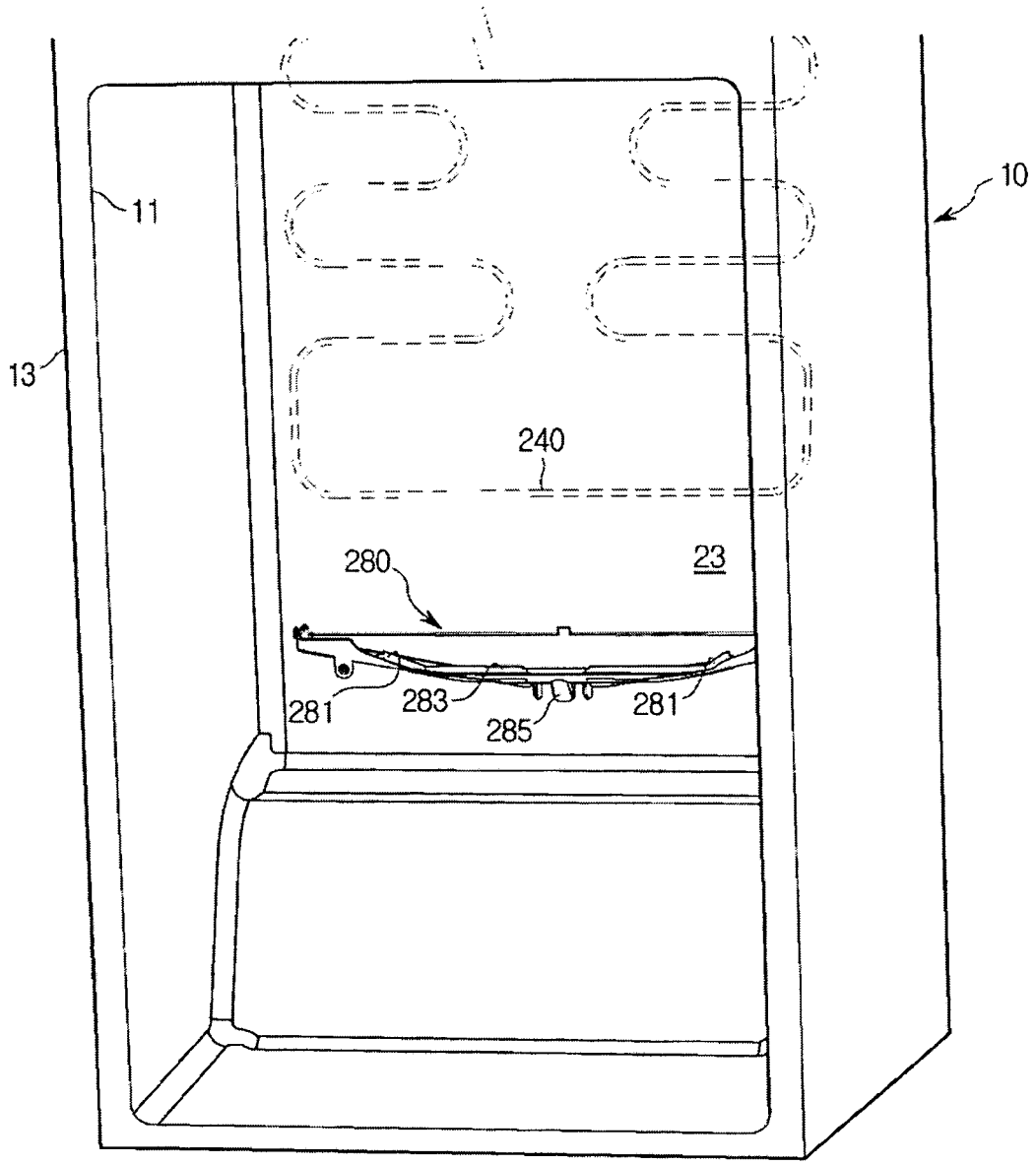
FIG. 13 is a view showing a drain unit shown in FIG. 12.
Figure 14:
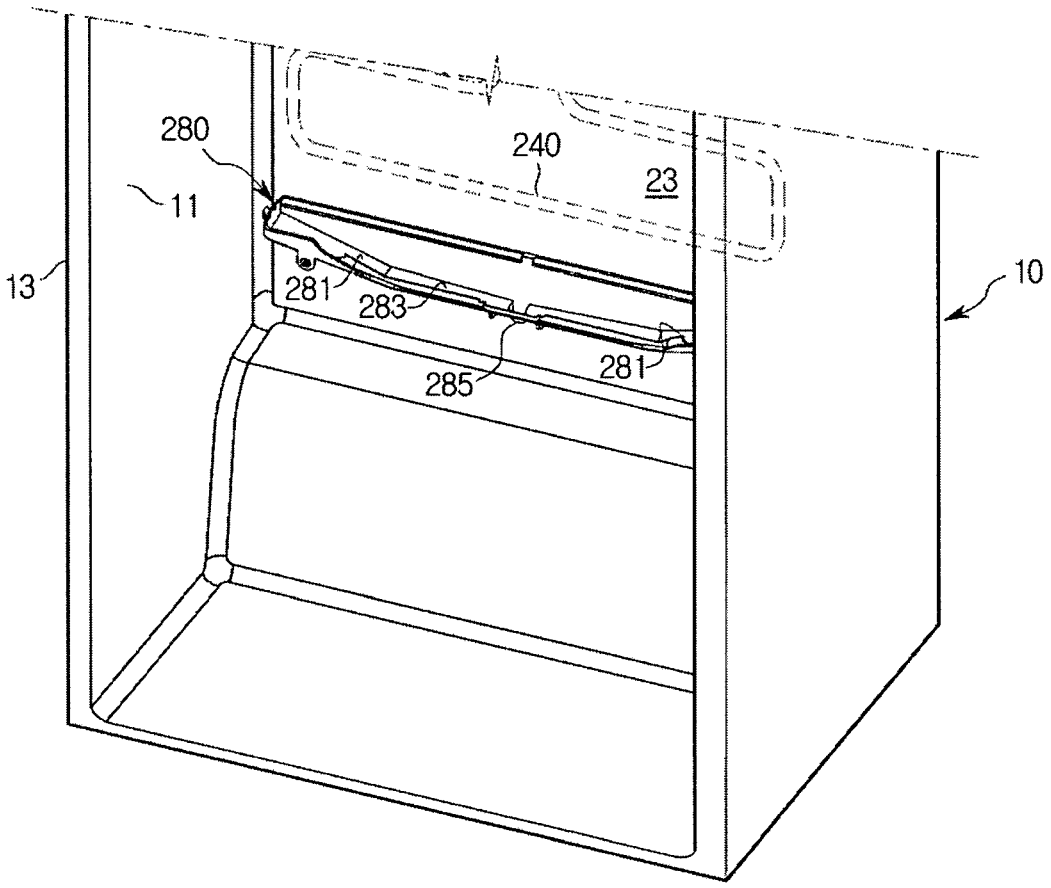
FIG. 14 is a view showing the drain unit shown in FIG. 13 from a different angle.

As shown in FIGS. 12 to 14, when the second cool pack 220 is provided inside the partition wall 17 in a manner to be positioned below the suction flow passage 77, a refrigerant pipe 240 in which a refrigerant is circulated may be provided in an upper portion outside the inner box 11 and a rear wall outside the inner box 11. The second cool pack 220 positioned below the suction flow passage 77 may store the cold storage energy from the cold air passing through the suction flow passage 77.

The portion of the refrigerant pipe 240 in the upper portion of the outer side of the inner box 11 is positioned below the second cool pack 220, and therefore the refrigerant passing through the refrigerant pipe 240 may be condensed by the cold storage energy stored in the second cool pack 220.

The refrigerant becomes heavier as it condenses and, therefore, the refrigerant flows down the refrigerant pipe 240 provided in the rear wall outside the inner box 12. This portion of the refrigerant pipe 240 may be in a downward direction from the part of the refrigerant pipe 240 provided in the upper portion of the outer side of the inner box 11. The refrigerant flowing down to the refrigerant pipe 240 provided in the rear wall outside the inner box 12 may cool the inside of the refrigerating chamber 23 while being evaporated through heat exchange with the inside of the refrigerating chamber 23.

The refrigerant passing through the refrigerant pipe 240 provided in the rear wall outside the inner box 12 is evaporated to become lighter, and, therefore, the refrigerant moves to the refrigerant pipe 240 provided in the upper portion of the outer side of the inner box 11 again to be circulated in the refrigerant pipe 240.

A valve for controlling the opening and closing of the refrigerant pipe 240 is not provided on the refrigerant pipe 240, and the refrigerant is circulated by change in specific gravity due to condensation and evaporation of the refrigerant. Therefore, the refrigerant is always circulated in the refrigerant pipe 240 irrespective of whether there is power or not, and the refrigerating chamber 23 is cooled by the refrigerant circulating in the refrigerant pipe 240. Since the refrigerating chamber 23 is cooled by the refrigerant circulating in the refrigerant pipe 240, an increase in the temperature of the refrigerating chamber 23 may be delayed during the power failure.

When the refrigerant circulating in the refrigerant pipe 240 cools the refrigerating chamber 23 due to evaporation, dew may form on an inner surface of the refrigerating chamber 23 of the inner box 11 in which the refrigerant pipe 240 is provided due to temperature difference between the inside and the outside of the refrigerating chamber 23. A drain unit 280 is provided on an inner surface of the inner box 11 so the dew formed on the inner box 11 flows down and is drained to the outside, and is positioned below a lower end of the refrigerant pipe 240 provided on the rear wall outside the inner box 11.

The drain unit 280 has a configuration including an inclined surface 281 provided to incline downwardly towards the center of the drain unit 280 from both ends thereof and a water storage portion 283 may be between the inclined surfaces 281 at both ends of the drain unit 280 so that the dew water flowing down from the inner box 11 is stored in the water storage portion 283. A drain port 285 may be provided in a center portion of the water storage portion 283 so that the dew water stored in the water storage portion 283 is drained to the outside of the main body 10, which has the same configuration as that of the drain unit 120 shown in FIGS. 2 and 3. However, when dew is formed on the inner box 11 by the refrigerant circulated in the refrigerant pipe 240, dew is formed on the entire inner box 11 that forms the rear wall of the refrigerating chamber 23, and therefore it is preferable that the drain unit 280 be longer than that of the drain unit 120 shown in FIGS. 2 and 3, and accordingly substantially span the width of the inner box 11.

As shown in the flow diagram 1200 of FIG. 12, the refrigerant circulated in the refrigerant pipe 240 is continuously circulated even during a power failure as well as when power is present, and, therefore, when the compressor 41 is in an OFF state when power is present [1202], the refrigerating chamber 23 may be excessively cooled by the circulating refrigerant. Accordingly, in order to prevent the refrigerating chamber 23 from being excessively cooled by the circulating refrigerant when the compressor 41 is in the OFF state, the blowing fan 45 may be controlled to blow for a predetermined time when the OFF state of the compressor 41 continues for a predetermined time or more, so that the cold air is circulated [1204].

In addition, when the blowing fan 45 is controlled to be on for a predetermined time when the OFF state of the compressor 41 continues for a predetermined time or more, the dew formation that occurs in the inner box 11 by the refrigerant circulated in the refrigerant pipe 240 may be prevented.

When the compressor 41 is in the OFF state when power is present, the cold air inside the freezing chamber 21 may be suctioned into the suction flow passage 77 without supplying the cold air to the freezing chamber 21, and the second cool pack 220 may store the cold storage energy of the suctioned cold air. This may lead to a higher temperature in the freezing chamber 21 than desired.

In order to compensate for the increase in the temperature of the freezing chamber 21 in the OFF state of the compressor 41, an ON state time may be controlled to become longer than the OFF state during the time when power is present. Accordingly, the time during which the cold air is supplied to the freezing chamber 21 may be increased, thereby cooling the freezing chamber 21 to a certain temperature or lower.

Figure 15:
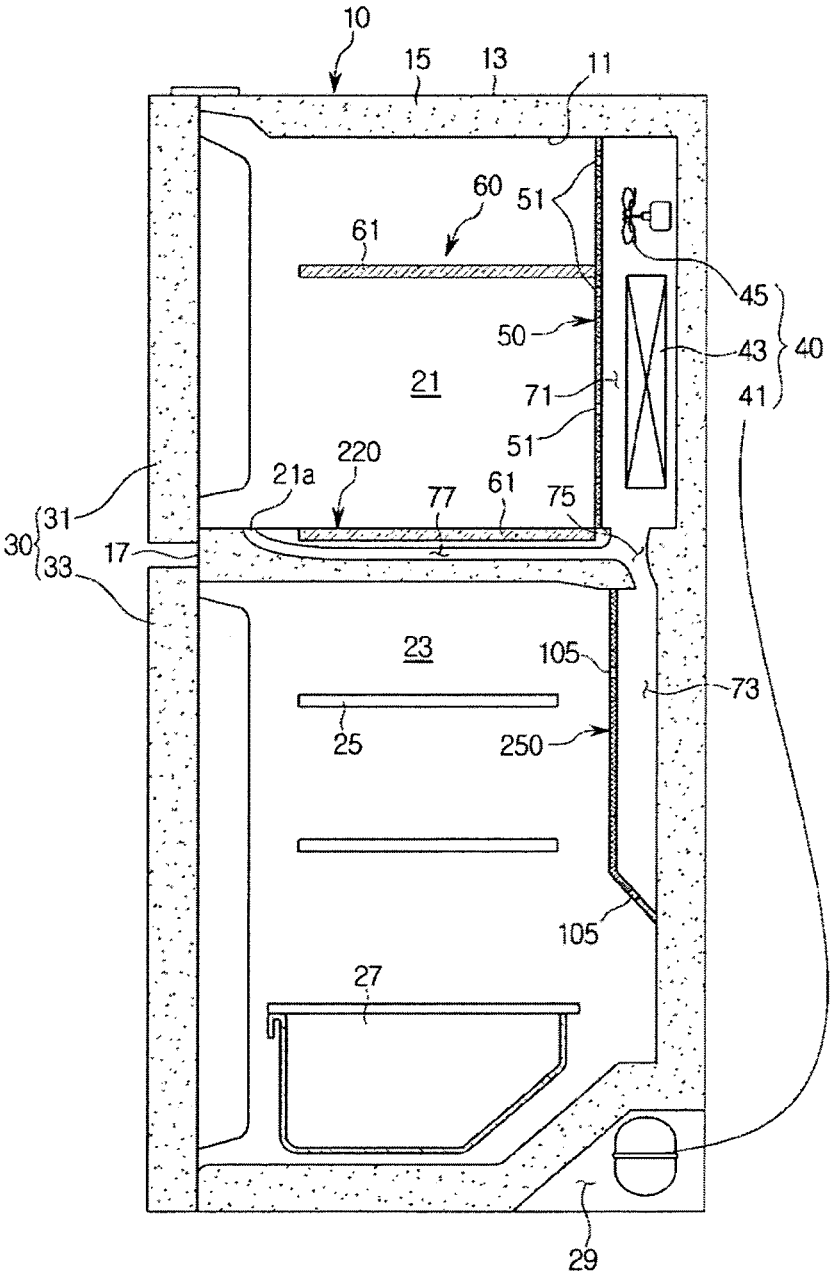
FIG. 15 is a view showing a state in which the second cool pack is provided inside a partition wall so that it is positioned above the suction flow passage in accordance with another embodiment of the present disclosure.

As shown in FIG. 15, the second cool pack 220 may be provided on the bottom surface of the freezing chamber 21 above the suction flow passage 77. The second cool pack 220 provided on the bottom surface of the freezing chamber 21 may store the cold storage energy from the cold air inside the freezing chamber 21 together with the cold air passing through the suction flow passage 77.

The cold storage energy stored in the second cool pack 220 may be transmitted to the second flow passage 73 via the connection flow passage 75 using the suction flow passage 77 during a power failure. The cold air transmitted to the second flow passage 73 may be transmitted into the refrigerating chamber 23 through the cold air duct 100, and thereby delay the increase in the internal temperature of the refrigerating chamber 23 during a power failure.

In this instance, the configuration of a cold air duct 250 may be the same as the configuration of the cold air duct 100 shown in FIG. 6. A difference may be that the heat insulating material 15 is packed in the cold air duct 250 instead of the freezer cold storage material 61 for the freezing chamber. Since the heat insulating material 15 is packed in the cold air duct 250, it is possible to prevent dew from being formed on the cold air duct 250 due to temperature difference. Since dew formation is prevented, neither a cold air duct cover nor a drain unit is required.

Figure 16:
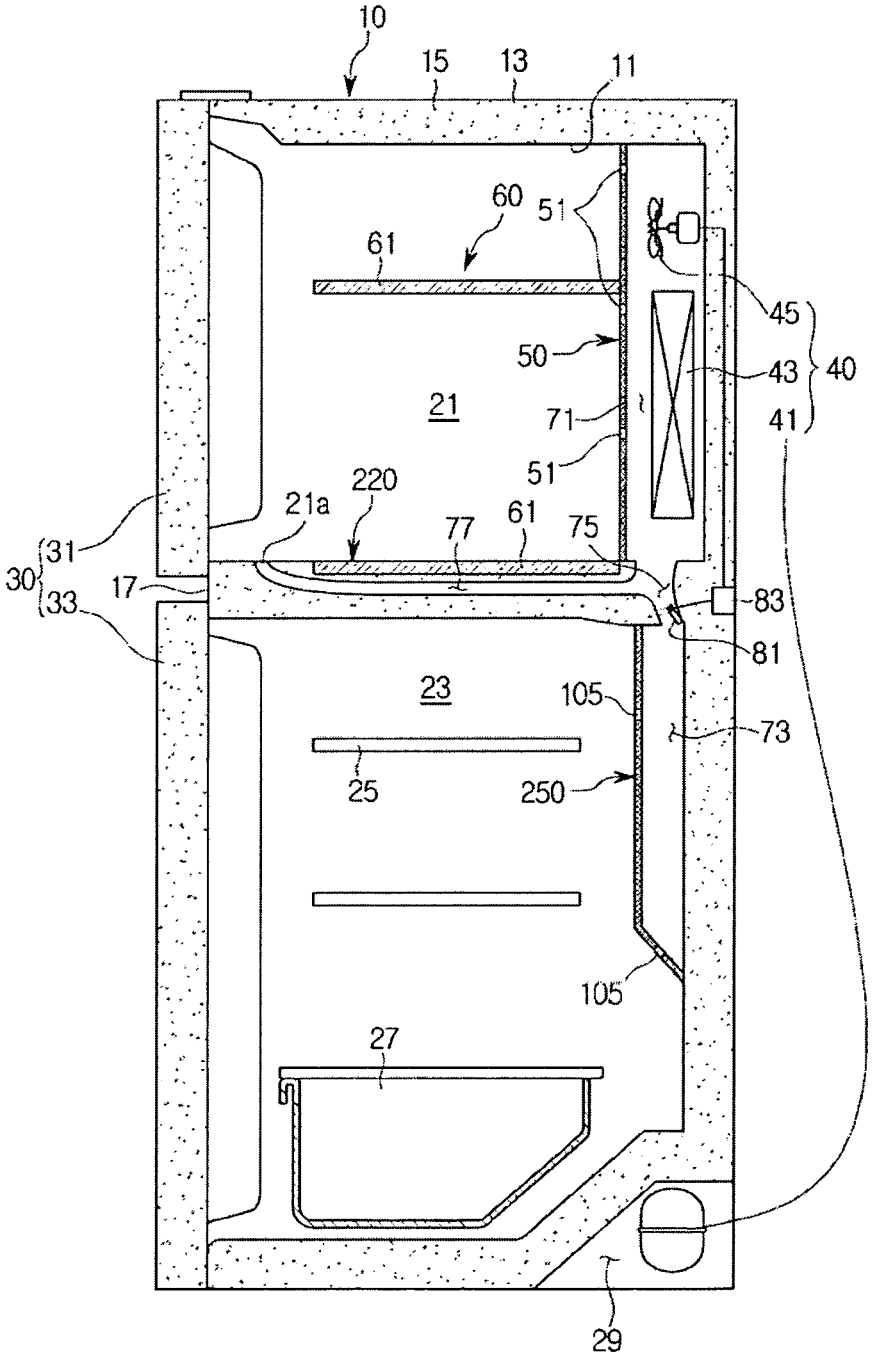
FIG. 16 is a view showing a state in which the damper and the control unit are provided in FIG. 15.

The damper 81 and the control unit 83 shown in FIG. 7 may be used even when the second cool pack 220 is provided on the bottom surface of the freezing chamber 21 above the suction flow passage 77 as shown in FIG. 16.

Figure 17:
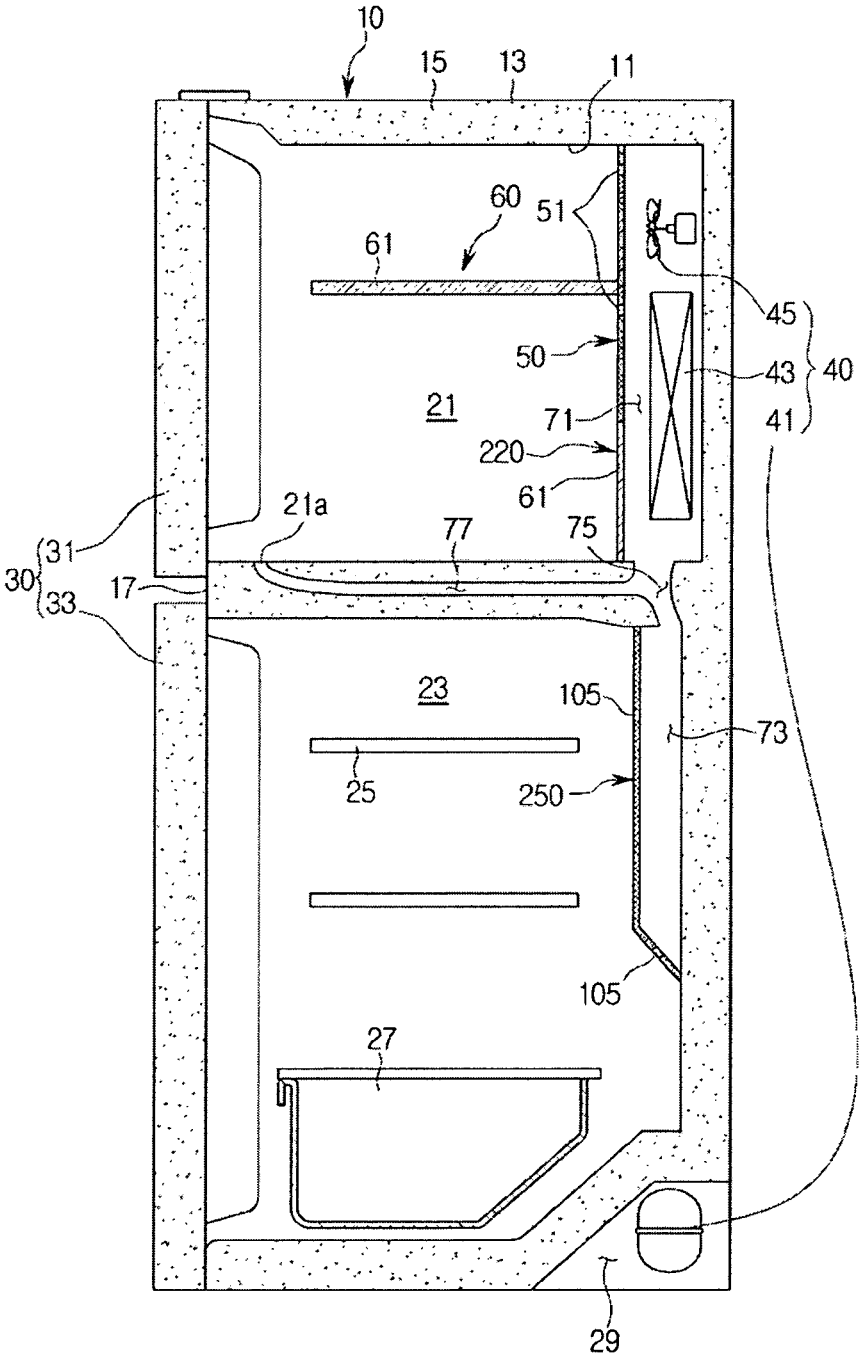
FIG. 17 is a view showing a state in which the second cool pack is provided in an evaporator cover in accordance with another embodiment of the present disclosure.

As shown in FIG. 17, the second cool pack 220 may be provided in a part of the evaporator cover 50. When the second cool pack 220 is provided in a part of the evaporator cover 50, the second cool pack 220 stores the cold storage energy from the cold air inside the freezing chamber 21 together and the cold air passing through the first flow passage 71.

The cold storage energy stored in the second cool pack 220 may be transmitted to the second flow passage 73 via the connection flow passage 75 during a power failure, and the cold storage energy transmitted to the second flow passage 73 may be supplied into the refrigerating chamber 23 through the cold air duct 250 and thereby may delay the increase in the internal temperature of the refrigerating chamber 23.

Figure 18:
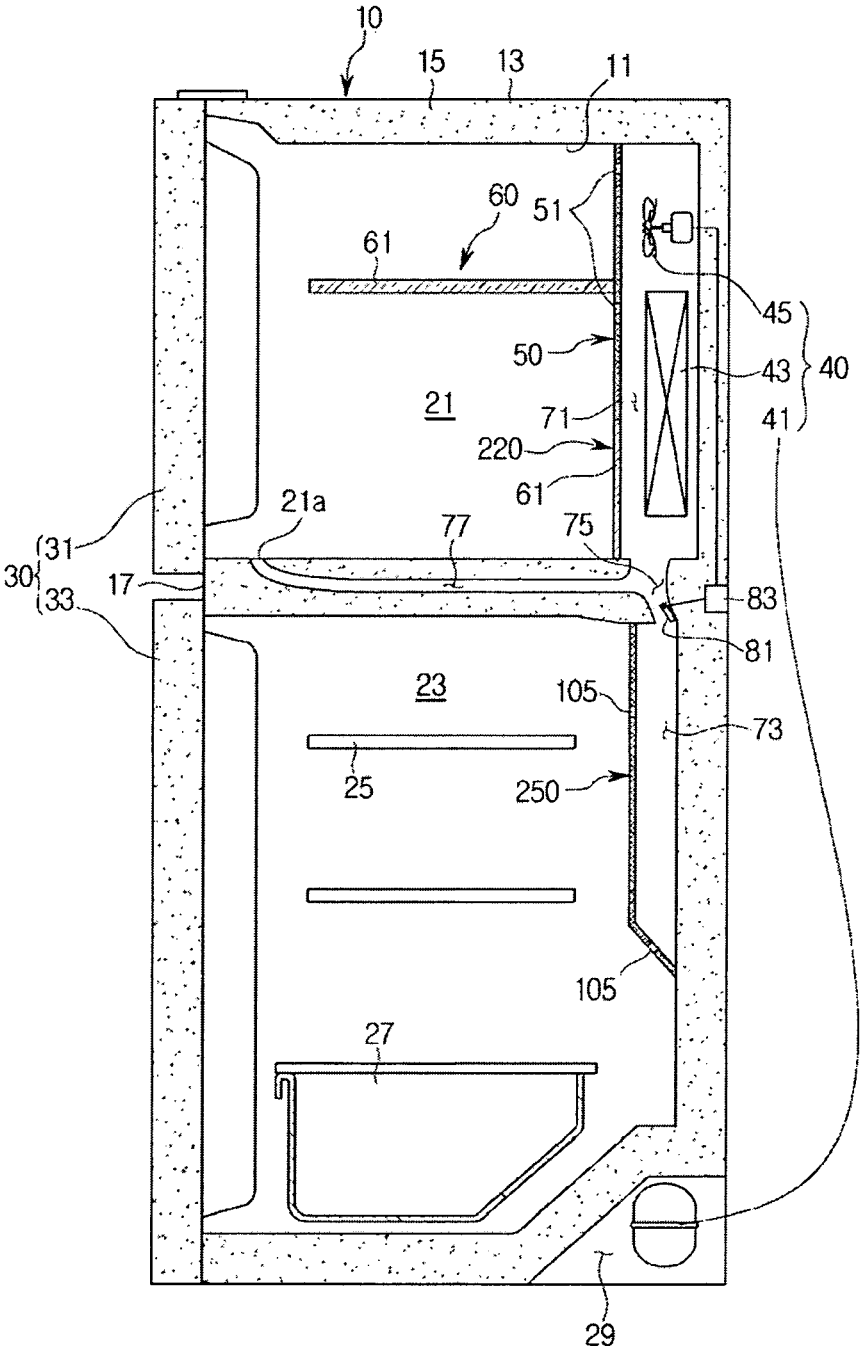
FIG. 18 is a view showing a state in which the damper and the control unit are provided in FIG. 17.

The configuration of the damper 81 and the control unit 83 shown in FIG. 7 may be equally applied even when the second cool pack 220 is provided in the evaporator cover 50 as shown in FIG. 18.

Figure 19:
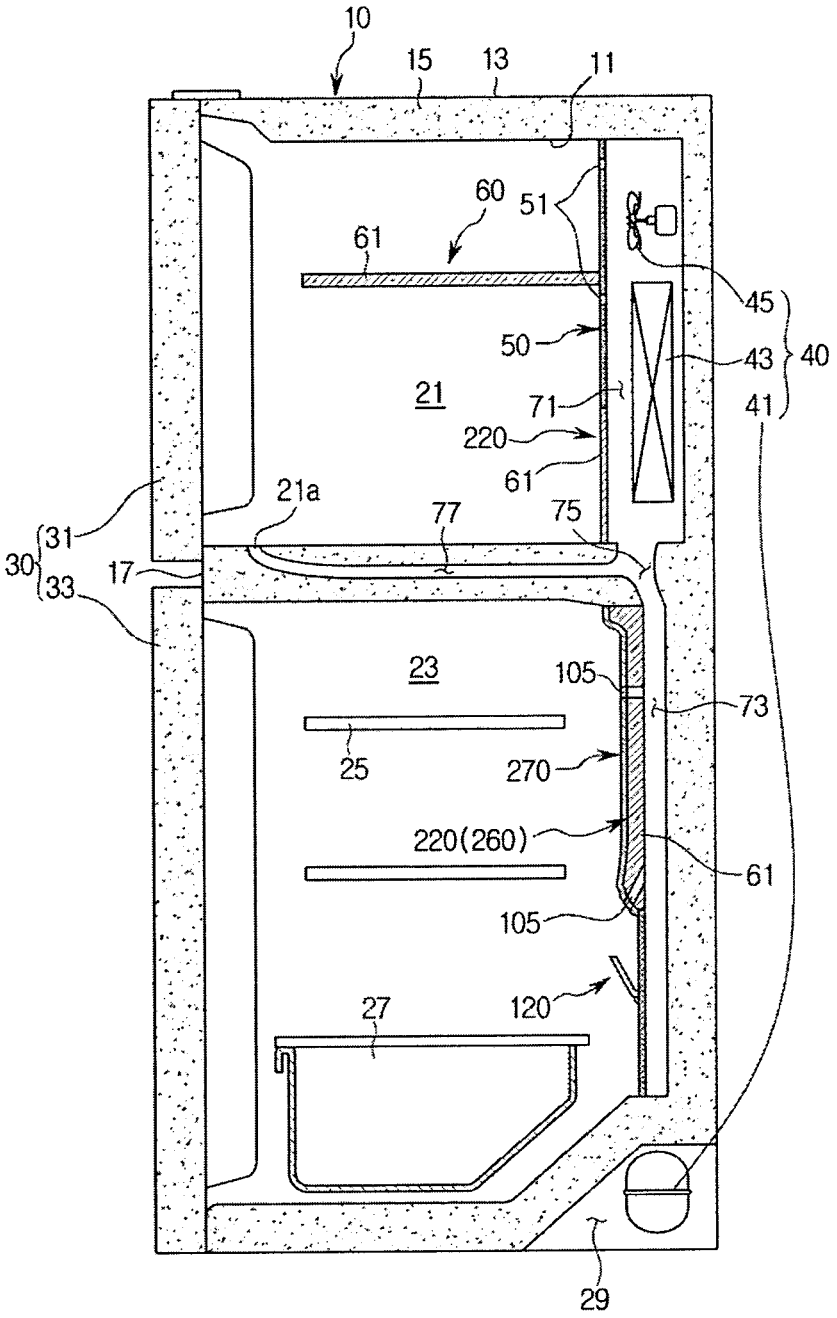
FIG. 19 is a view showing a state in which the second cool pack is provided in each of the evaporator cover and a cold air duct in accordance with another embodiment of the present disclosure.

As shown in FIG. 19, a first cool pack 60 and the second cool pack 220 may be provided in the evaporator cover 50 and a cold air duct 260, respectively. When the first cool pack 60 and the second cool pack 220 are provided in the evaporator cover 50 and the cold air duct 260, the first cool pack 60 in the evaporator cover 50 may store cold storage energy from the cold air inside the freezing chamber 21 and from the cold air passing through the first flow passage 71. The second cool pack 220 in the cold air duct 260 may store cold storage energy from the cold air passing through the second flow passage 73.

When the second cool pack 220 is provided in the cold air duct 260, the freezer cold storage material 61 for the freezing chamber 21 is in the cold air duct 260 in the same manner as that in the cold air duct 100 shown in FIG. 6. The configuration in which the cold air duct cover 270 is provided on a front surface of the cold air duct 260 may be the same as the configuration of the cold air duct cover 110 shown in FIG. 6.

The cold storage energy stored in the second cool pack 220 may be transmitted to the second flow passage 73 to be transmitted to the refrigerating chamber 23 through the cold air duct 260, and thereby may delay the increase in the internal temperature of the refrigerating chamber 23.

Figure 20:
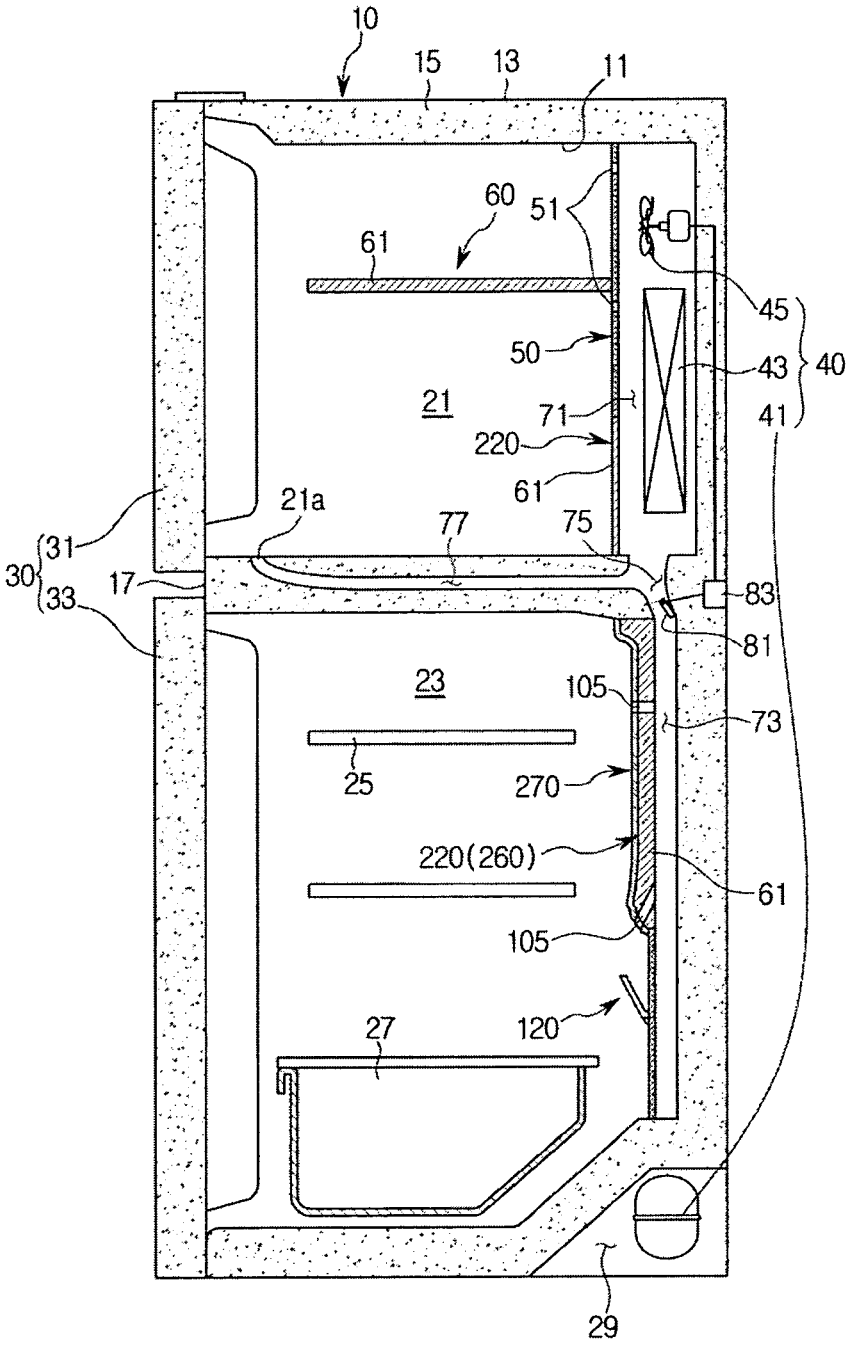
FIG. 20 is a view showing a state in which the damper and the control unit are provided in FIG. 19.

As shown in FIG. 20, even when the second cool pack 220 is provided in each of the evaporator cover 50 and the cold air duct 260, the configuration of the damper 81 and the control unit 83 shown in FIG. 7 may be applied.

According to various embodiments of the present disclosure, it is possible to delay the increase in the internal temperature of both the freezing chamber and the refrigerating chamber even when a power failure occurs while still reducing material costs.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage chamber disposed inside the main body;

a partition wall to divide the storage chamber into a freezing chamber and a refrigerating chamber;

an evaporator disposed in the freezing chamber and configured to generate cold air;

an evaporator cover disposed in front of the evaporator;

a blowing fan configured to blow the cold air to the freezing chamber and the refrigerating chamber and be on for a first selected time after a compressor is off for a second selected time;

a flow passage to allow the cold air to flow to the freezing chamber and the refrigerating chamber;

a first cool pack, disposed in the freezing chamber, comprising cold storage material to delay an internal temperature increase of the freezing chamber when power is not supplied to the refrigerator;

a second cool pack, disposed in the refrigerating chamber, comprising the cold storage material to delay an internal temperature increase of the refrigerating chamber when the power is not supplied to the refrigerator; and a cold air duct disposed in a rear portion of the refrigerating chamber configured to supply the cold air, by the blowing fan, to the refrigerating chamber via the flow passage, the cold air duct comprising:

the second cool pack;

an input port for introducing the cold storage material into the second cool pack; and a plurality of cold air discharge ports to allow the generated cold air in the flow passage to flow to the refrigerating chamber, wherein:

the flow passage comprises:

a first flow passage separated from the freezing chamber by the evaporator cover;

a second flow passage behind the cold air duct located in a rear portion of the refrigerating chamber;

a flow passage connection through the partition wall that connects the first flow passage and the second flow passage; and a suction flow passage inside the partition wall to allow the cold air to flow from the freezing chamber to the first flow passage via the suction flow passage;

when the power is not supplied to the refrigerator, cold energy stored in the first cool pack and cold energy stored in the second cool pack is supplied to both the refrigerating chamber and the freezing chamber and thereby delay the internal temperature increase of both the refrigerating chamber and the freezing chamber;

the evaporator cover comprises a discharge port to allow the cold air in the first flow passage to flow to the freezing chamber, and a suction port on a bottom surface of the freezing chamber to allow the cold air in the freezing chamber to flow to the suction flow passage;

the second cool pack is positioned below the suction flow passage;

cold energy stored in the second cool pack is from the cold air passing through the suction flow passage; and a plurality of embossed shapes are provided on a bottom surface of the second cool pack.

2. The refrigerator according to claim 1, wherein a refrigerant pipe, in which refrigerant is circulated, is provided in an upper portion outside an inner box forming the refrigerating chamber and a rear wall outside the inner box, and the cold energy stored in the second cool pack is provided to the refrigerating chamber via the refrigerant.

3. The refrigerator according to claim 1, further comprising a damper configured to open or close the flow passage and a controller configured to control an operation of the damper so that when the power is not supplied to the refrigerator, the controller is configured to control the damper to open the flow passage to supply the cold energy stored in the first cool pack to the refrigerating chamber and the freezing chamber.

4. The refrigerator according to claim 1, wherein cold energy stored in the second cool pack is from the cold air flowing in the second flow passage via the suction flow passage and the flow passage connection, and the cold air in the second flow passage flows in to the refrigerating chamber.

5. The refrigerator according to claim 1, wherein a cool pack cover is provided below the second cool pack, and a plurality of holes are provided in the cool pack cover.

6. The refrigerator according to claim 5, wherein the cold energy stored in the second cool pack is provided to the refrigerating chamber by flow of the cold air through the plurality of holes of the cool pack cover.

7. The refrigerator according to claim 1, wherein the first cool pack is provided in the evaporator cover and cold energy stored in the first cool pack is from the cold air passing through the first flow passage.

8. The refrigerator according to claim 7, wherein the cold energy stored in the second cool pack is provided to the refrigerating chamber by flow of the cold air via the flow passage connection, the flow passage, the second flow passage, and through the cold air duct.

9. The refrigerator according to claim 1, wherein the first cool pack is provided in the evaporator cover and the second cool pack is provided in the cold air duct, so that cold energy stored in the first cool pack and the second cool pack is from the cold air flowing through the first flow passage and the second flow passage, respectively.

10. The refrigerator according to claim 9, wherein the cold energy stored in the first cool pack and the second cool pack is provided to the refrigerating chamber.

* * * * *